US006562185B2

(12) United States Patent
Avanzino et al.

(10) Patent No.: US 6,562,185 B2
(45) Date of Patent: May 13, 2003

(54) WAFER BASED TEMPERATURE SENSORS FOR CHARACTERIZING CHEMICAL MECHANICAL POLISHING PROCESSES

(75) Inventors: Steven C. Avanzino, Cupertino, CA (US); Bhanwar Singh, Morgan Hill, CA (US); Bharath Rangarajan, Santa Clara, CA (US); Ramkumar Subramanian, Sunnyvale, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/955,552

(22) Filed: Sep. 18, 2001

(65) Prior Publication Data

US 2003/0055526 A1 Mar. 20, 2003

(51) Int. Cl.[7] ..... B24B 37/00; H01L 21/304
(52) U.S. Cl. ..... 156/345.13; 451/8
(58) Field of Search ..... 156/345.13; 451/8

(56) References Cited

U.S. PATENT DOCUMENTS

| | | | | |
|---|---|---|---|---|
| 5,643,050 | A | * 7/1997 | Chen | 451/10 |
| 5,851,135 | A | * 12/1998 | Sandhu et al. | 451/5 |
| 5,873,769 | A | * 2/1999 | Chiou et al. | 451/7 |
| 5,882,244 | A | 3/1999 | Hiyama et al. | |
| 6,007,408 | A | 12/1999 | Sandhu | |
| 6,352,466 | B1 | * 3/2002 | Moore | 451/5 |
| 6,399,501 | B2 | * 7/2002 | Birang et al. | 438/692 |
| 6,402,589 | B1 | * 7/2002 | Inaba et al. | 451/5 |
| 6,413,147 | B1 | * 7/2002 | Litvak | 451/7 |

FOREIGN PATENT DOCUMENTS

| | | |
|---|---|---|
| JP | 10-214807 | * 8/1998 |
| JP | 11-33897 | * 2/1999 |
| JP | 2000-340538 | * 12/2000 |

OTHER PUBLICATIONS

Smith, Taber H., et al. *Process Control in the Semiconductor Industry.* http://www–mtl.mit.edu/~taber/Research/Process_Control/IERC99/. pp. 1–24. Last viewed on Sep. 26, 2000.

International Search Report dated Jul. 24, 2002 for PCT International Patent Application No. PCT/US02/10479 filed Apr. 5, 2002.

* cited by examiner

*Primary Examiner*—Gregory Mills
*Assistant Examiner*—Sylvia R. MacArthur
(74) *Attorney, Agent, or Firm*—Amin & Turocy, LLP

(57) ABSTRACT

A system for characterizing a chemical mechanical polishing process is provided. The system includes a wafer that has a metal, polysilicon, and/or dielectric layer and/or substrate and a temperature sensor located in and/or on the metal, polysilicon and/or dielectric layer and/or substrate. The system also includes a temperature monitoring system that can read the wafer temperature from the temperature sensors and that can analyze the wafer temperature to characterize the chemical mechanical polishing process. Such characterization includes producing information concerning relationships between wafer temperature and polishing rate, polishing uniformity and introduction of defects during polishing. Such relationships are correlated with wafer temperature as related to parameters like polishing time, pressure, speed, slurry properties and wafer/metal layer properties. Such characterization can be employed, for example, to better understand a CMP process, to facilitate initializing subsequent chemical mechanical polishing processes and/or apparatus and/or to control such chemical mechanical polishing processes and/or apparatus by monitoring and/or controlling wafer temperature.

31 Claims, 15 Drawing Sheets

WAFER BASED TEMPERATURE SENSORS FOR CHARACTERIZING CHEMICAL MECHANICAL POLISHING PROCESSES

TECHNICAL FIELD

The present invention generally relates to semiconductor processing, and in particular to a system and method for characterizing chemical mechanical polishing (CMP) processes via wafer based temperature sensors.

BACKGROUND

As semiconductors have become more complicated (e.g., increasing number of interconnect layers), the planarization of dielectric and metal layers has become more important to achieving desired critical dimensions (CDs) in such semiconductors. One technique employed in the planarization of layers is chemical mechanical polishing (CMP). In general, CMP is a surface planarization technique in which a wafer is processed by a polishing pad in the presence of an abrasive slurry (although recent slurry-free techniques are also employed). One goal of CMP is more global planarization with stricter planarization tolerances and more repeatable results. In CMP, high elevation features are selectively removed resulting in a topology with improved planarity. Such removal is achieved, at least in part, via a combination of a chemical process and an abrasive process, both of which affect and/or are affected by the temperature of the wafer.

Some goals of CMP include achieving satisfactory planarity across a wafer, achieving desired film thickness uniformity, removing chemical reaction products and/or layers at a desired rate, achieving desired selectivity and/or endpoint detection and to not introduce defects into a wafer undergoing CMP. Whether these goals are achieved can depend on a variety of factors. Removal rate may depend, for example, on the type of material being removed, the relative velocity between the wafer and the abrasive pad, the temperature of the wafer, the slurry feed rate, the type of polishing motion employed, the slurry formula, the slurry pH, the concentration of solids in the slurry, slurry particle size, pad hardness and pad conditioning.

The mechanics of metal CMP include chemically forming an oxide of the metal on the metal film surface on the wafer. The oxide is then removed mechanically via, for example, abrasives in the slurry. The mechanics of other CMP (e.g., polysilicon polish, dielectric polish) similarly involve a chemical reaction followed by a mechanical removal of reaction products. The rate of the chemical reduction reaction, which facilitates selectively removing the metal films and/or other layers and/or reaction products during CMP, is strongly temperature dependant. Conventionally, such temperature, if measured at all, was measured indirectly via analysis of the temperature of the polishing pad(s).

The polishing pad facilitates precisely removing reaction products at the wafer interface to facilitate precise layer thickness production. For example, CMP processes can be employed to precisely remove around 0.5 to 1.0 $\mu$m of material. The polishing pads may vary, for example, in hardness and density. For example, pads can be relatively stiff or relatively flexible. A less stiff pad will conform more easily to the topography of a wafer and thus while reducing planarity may facilitate faster removal of material in down areas. Conversely, a more stiff pad may produce better planarity but may result in slower removal in down areas. The degree to which the pad conforms to the topography can affect the friction between the pad, slurry and wafer, and thus can affect the temperature of the wafer. Furthermore, the polishing pads may glaze during processing of wafers, which again may affect the abrasiveness and thus heat generated by friction during CMP. For example, a new pad may achieve a removal rate of around 210 nm/min while a pad that has been employed to polish fifty wafers may only achieve a removal rate of around 75 nm/min. Thus, the rate at which CMP progresses may vary depending on the temperature of the wafer, which can be affected, for example, by the hardness, density and glazing of the pad employed.

The rate at which CMP progresses may also vary depending on parameters of the slurry employed. Slurries may consist, for example, of small abrasive particles suspended in a solution (e.g., aqueous solution). Acids or bases can be added to such solutions to facilitate, for example, the oxidation of the metal on the wafer and/or other chemical reactions involved in other non-metal CMP processes. Slurry parameters that may impact polishing rates include, but are not limited to, the chemical composition of the slurry, the concentration of solids in the slurry, the solid particles in the slurry and the temperature of the wafer to which the slurry is applied. Thus, once again, the temperature of the wafer is involved in the progress of the CMP.

Conventional CMP processes have either lacked control systems, requiring pre-calculated CMP parameters based on theoretical or indirect empirical data, or have had indirect control, which is based on indirect information (e.g., indirect temperature measurements of polishing pad). Such predetermined, theoretical and/or indirect measurement based parameters do not provide adequate initialization and/or monitoring and thus do not facilitate precise characterization and/or control of the CMP process.

Fabricating an integrated circuit (IC) typically includes sequentially depositing conducting, semiconducting and/or insulating layers on a silicon wafer. One fabrication step includes depositing a metal layer over previous layers and planarizing the metal layer. For example, trenches or holes in an insulating layer may be filled with a conducting metal. After CMP planarization, portions of the conductive metal remaining between the raised pattern of an insulating layer may form, for example, vias, plugs and/or lines. The precision with which such vias, plugs and/or lines can be formed affects the achievable CDs for an IC, and thus improvements in characterizing and/or controlling a CMP process are desired.

SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. Its sole purpose is to present some concepts of the invention in a simplified form as a prelude to the more detailed description presented later.

The present invention provides a system and method that facilitates characterizing and/or controlling a chemical mechanical polishing (CMP) process by gathering wafer temperature information during CMP processing, where the wafer temperature is measured directly from sensors in the wafer. Thus, accuracy improvements over conventional systems that only indirectly measure wafer temperature by measuring the temperature of an abrasive pad may be achieved. Thus, the system includes wafer based sensors and apparatus to retrieve the wafer temperature from such wafer based sensors. One example of the system further includes a data store that can be employed to store data including, but not limited to, temperature information, slurry information, wafer information, motion (e.g., rotary, orbital, linear) information, pressure information and abrasive pad information associated with the CMP process being characterized. Another example of the system further includes a CMP control system that can be employed to analyze such temperature, slurry, wafer, pressure, motion, and/or pad information to facilitate characterizing a CMP process, to facilitate selecting CMP process parameters and/or for controlling, in-situ, a CMP process.

The present invention thus provides a technique to monitor the surface temperature of a wafer during CMP processing. The present invention can be employed in CMP processing of metal films including, but not limited to, copper (Cu), tantalum (Ta), tungsten (W), aluminum (Al) and titanium (Ti), for example. The metal film can be subjected to a chemical reaction (e.g., oxidation), where the chemical reaction is dependant on the temperature of the wafer and/or the metal film. The present invention can also be employed in CMP processing of layers including, but not limited to, polysilicon layers and dielectric layers. Since the polish rate is affected by the rate of chemical reaction, the polish rate is therefore affected by the temperature of the wafer and/or film. Thus, monitoring the temperature of the wafer and/or film can provide data that facilitates characterizing a CMP process and thus improving wafer quality.

In addition to measuring the temperature of the wafer, layer and/or metal film, the present invention facilitates measuring radial temperature gradients, which can facilitate improving within wafer planarization uniformity, with resulting improvements in wafer quality.

In one example of the present invention, an array of temperature sensors is integrated into a silicon wafer substrate to directly measure wafer temperature during CMP. To facilitate retrieving wafer temperatures, the substrate may include signal processing circuitry, a power source, an electrical temperature transducer and other components, for example.

In another example of the present invention, the system includes a wafer that has a metal layer and/or substrate and a temperature sensor located in and/or on the metal layer and/or a substrate. The system also includes a temperature monitoring system that can read the wafer temperature from the temperature sensors and that can analyze the wafer temperature to characterize the CMP process. Characterizing the CMP process includes producing information concerning factors including, but not limited to, polishing rate, polishing uniformity and introduction of defects during polishing. The factors can be correlated, for example, with polishing parameters including, but not limited to, polishing time, polishing temperature, polishing pressure, polishing speed, slurry properties and wafer/metal layer properties as related to wafer temperature information. For example, rotation speed, pressure and removal rate may be identifiable by the temperature of the wafer. Such characterization can be employed, for example, to facilitate initializing subsequent chemical mechanical polishing processes and/or apparatus and/or to control such chemical mechanical polishing processes and/or apparatus.

To the accomplishment of the foregoing and related ends, the invention, then, comprises the features hereinafter fully described and particularly pointed out in the claims. The following description and the drawings set forth in detail certain illustrative embodiments of the invention. These embodiments are indicative, however of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The present invention is illustrated by way of example in the accompanying figures.

DETAILED DESCRIPTION

Figure 1:
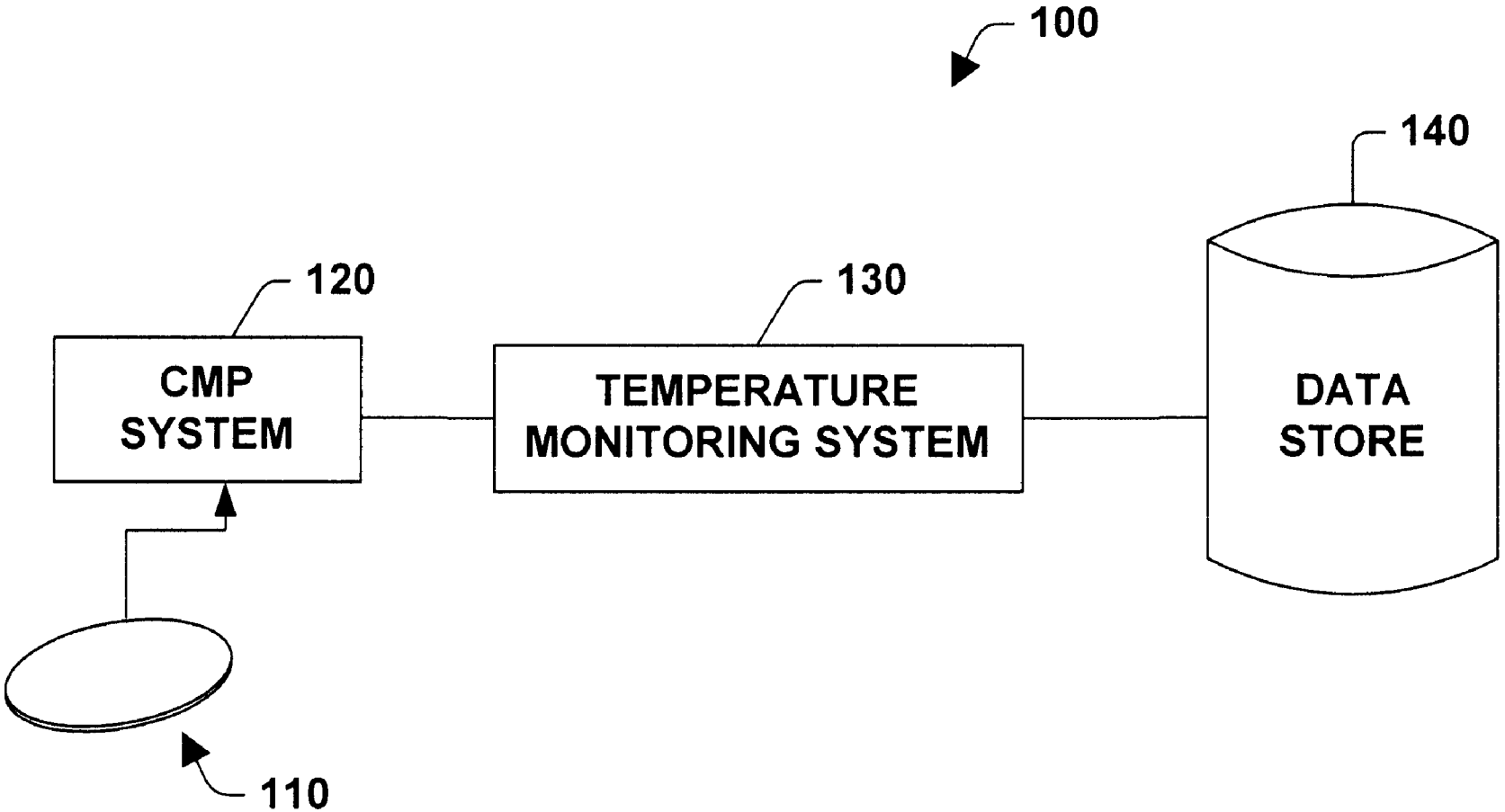
FIG. 1 is a block diagram of a CMP characterizing system, in accordance with an aspect of the present invention.

The present invention will now be described with reference to the drawings, where like reference numerals are used to refer to like elements throughout. The following detailed description is of the best modes presently contemplated by the inventors for practicing the invention. It should be understood that the description of these aspects are merely illustrative and that they should not be taken in a limiting sense.

FIG. 1 is a block diagram of a CMP characterizing system 100. The system 100 includes a wafer 110, where the wafer 110 is associated with one or more temperature sensors. The wafer 110 may include, for example, one or more metal layers, one or more polysilicon layers, one or more dielectric layers and/or one or more substrate layers. The temperature sensors can, therefore, be located in and/or on the metal layers, the polysilicon layers, the dielectric layers and/or the substrate layers. It is to be appreciated that any of a variety of temperature sensors known in the art may be employed in accordance with the present invention. The wafer 110 is provided to a CMP system 120 for CMP processing. One example CMP system 120 and CMP process is described in greater detail in association with FIGS. 8 and 9. While FIGS. 8 and 9 describe one example CMP system 120 and process, it is to be appreciated that such description is illustrative and that the present invention can be employed with other CMP systems and/or processes.

The CMP system 120 performs a chemical mechanical polish of the wafer 110. Before, during and/or after the CMP of the wafer 110, temperature readings are taken from the temperature sensors in the wafer 110 by the temperature monitoring system 130. Such temperature readings may be taken, for example, at pre-determined intervals, continuously, randomly, according to a schedule and at other times. Such temperature readings may be, for example, absolute temperature readings and/or difference readings from a pre-determined threshold temperature. For example, at a first time the temperature monitoring system 130 may gather the actual temperature of a wafer 110 and at subsequent times may gather the difference in the temperature at such subsequent times.

The temperature monitoring system 130 can selectively store temperature information in a data store 140. The temperature information may include, but is not limited to, the temperature of the wafer 110 before the CMP process, wafer temperatures recorded during the chemical mechanical polishing process and the time associated with such reading, temperatures recorded after revolutions of a polishing pad during the chemical mechanical polishing process and the number of revolutions associated with such reading, and temperatures recorded after percentages of the layers (e.g., metal, polysilicon, dielectric) have been removed during the chemical mechanical polishing process and the percentage removed associated with such reading.

While one wafer 110 is illustrated, it is to be appreciated that a greater number of wafers 110 may be presented to the CMP system 120 for CMP and for analysis by the temperature monitoring system 130. Such wafers may vary in the type, number, arrangement and location of sensors, for example. Furthermore, such wafers may vary in layer type, layer thickness, type and initial planarity, for example. By passing a number of wafers 110 through the CMP system 120, relations can be formed that facilitate correlating temperature information, wafer information, pad information, slurry information, pressure information and motion information, for example. By way of illustration, metal CMP that employs an oxidation reaction may be characterized. By way of further illustration, polysilicon CMP and dielectric polish that employ other chemical reactions (e.g. hydrolysis of Si—O—Si bonds at the film surface prior to silica removal) may be characterized.

While one data store 140 is illustrated, it is to be appreciated that the temperature data can be stored in data structures including, but not limited to one or more lists, arrays, tables, databases, stacks, heaps, linked lists and data cubes. The data store 140 can reside on one physical device and/or may be distributed between two or more physical devices (e.g., disk drives, tape drives, memory units).

In general, CMP is a surface planarization technique in which a wafer 110 is processed by a polishing pad in the presence of an abrasive slurry (although recent slurry-free techniques are also employed). In CMP, high elevation features are selectively removed resulting in a topology with improved planarity. Such removal is achieved, at least in part, via a combination of a chemical process (e.g., oxidation) and an abrasive process, both of which affect and/or are affected by the temperature of the wafer 110. As discussed in the background section, abrasive pads employed by a CMP system 120 can glaze, which causes their performance to vary with the number of wafers 110 polished. Furthermore, pads may have varying stiffness. Thus, the CMP system 120 may record information associated with such pad variables, which facilitates the temperature monitoring system 130 storing temperature information correlated with such pad information. Thus, a relation between wafer temperature and pad glazing may be monitored that can be employed, for example, to identify pad reconditioning times. Similarly, a slurry employed by a CMP system 120 may have various properties including, but not limited to, the concentration of the slurry, the formula of the slurry, the pH of the slurry, the dispensing rate of the slurry, the particle size of the slurry, the concentration of solids in the slurry and the particle density of the slurry. Thus, the CMP system 120 may record information associated with such slurry variables, which facilitates the temperature monitoring system 130 storing temperature information correlated with such slurry information. Thus, a relation between temperature and slurry parameters may be monitored that can be employed, for example, to identify slurry parameters for achieving desired temperatures and thus desired polish rates. Furthermore, the CMP system 120 may record pressure and motion information associated with a CMP process. Such pressure information may include, but is not limited to, the initial pressure employed during the CMP, the average pressure employed during the CMP, the minimum pressure employed during the CMP and the maximum pressure employed during the CMP. Similarly, the motion information may include, but is not limited to, the initial rotational, orbital and/or linear speed employed during the CMP, the average rotational, orbital and/or linear speed during the CMP, the minimum rotational, orbital and/or linear speed employed during the CMP and the maximum rotational, orbital and/or linear speed employed during the CMP. Again, storing such pressure and/or motion information facilitates the temperature monitoring system 130 storing temperature information correlated with such information and monitoring relations that can be studied to understand the affects of varying pressures and motions on wafer temperature.

With information like temperature information, wafer information, pad information, slurry information, pressure information and motion information stored in the data store 140, the CMP processes performed by the CMP system 120 may be characterized. Such characterization may include, but is not limited to, producing information concerning relationships between wafer temperature and polishing rate, polishing uniformity, polishing time, polishing effects on pads, slurry usage and the introduction of defects to the wafer. Such characterization is based, at least in part, on relations between factors including, but not limited to, the wafer temperature, the polishing time, pressure, speed, slurry, wafer characteristics and the like. With such characterization data in hand, CMP processes performed by a CMP system 120 can be better understood, leading to improvements in semiconductor manufacturing efficiency and quality. Furthermore, such characterization data can be employed, for example, to facilitate initializing production CMP runs to optimize such production runs. In one example of the present invention, discussed in association with FIG. 7, such characterization data may also be employed in controlling a CMP process.

Thus, rather than ignoring wafer temperature, or only indirectly measuring wafer temperature, the present invention gathers direct temperature readings from wafers during a CMP process to facilitate characterizing such a CMP process, with the characterization, in one example of the present invention, correlating the temperature readings with other CMP parameters to produce a more complete CMP characterization.

Figure 2:
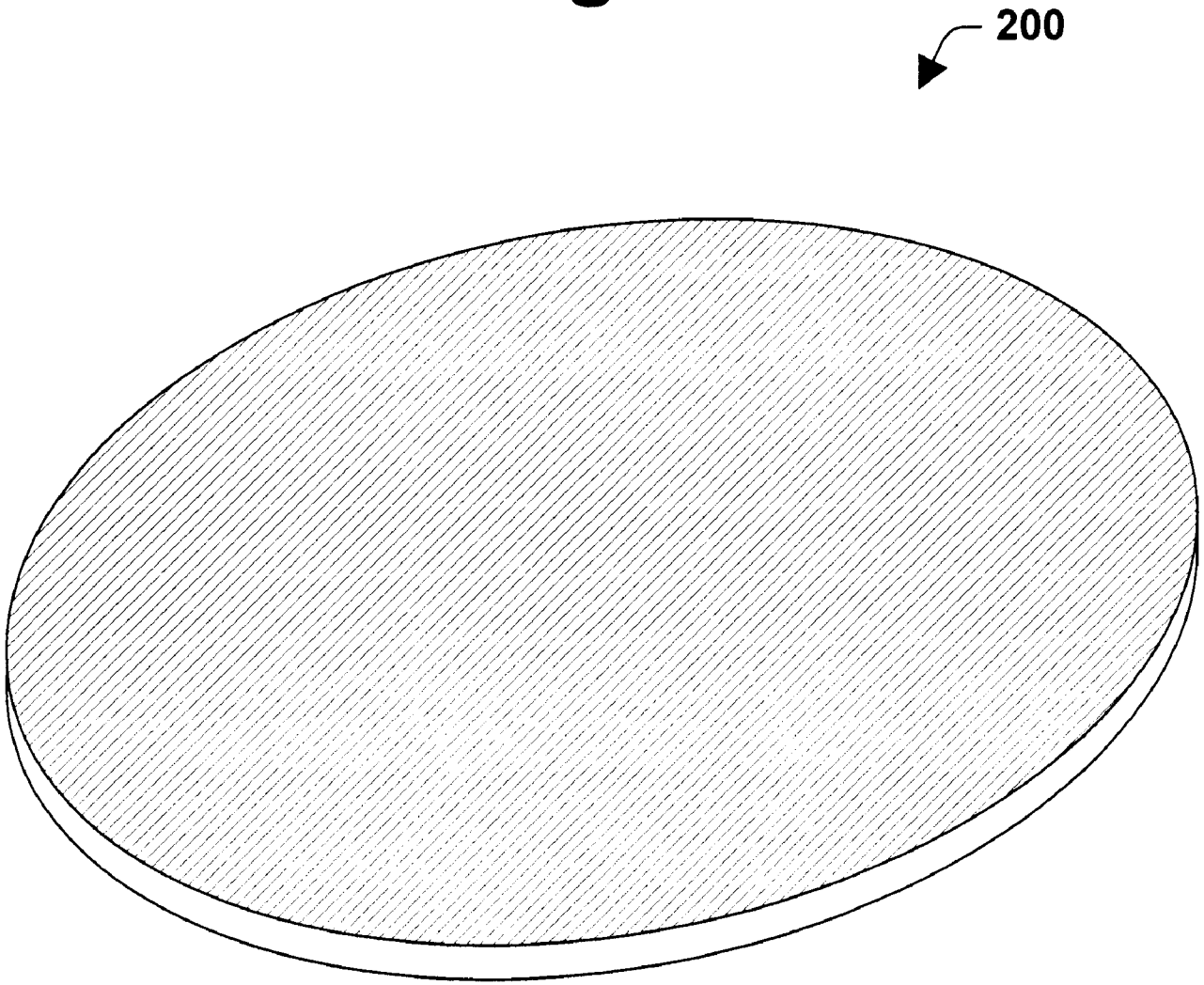
FIG. 2 illustrates a wafer with no associated temperature sensors.

Turning now to FIG. 2, a typical semiconductor wafer 200 with no associated temperature sensors is illustrated. Such a wafer 200 may include one or more substrate layers (e.g., $SiO_2$), one or more conducting layers (e.g., metal), one or more semiconducting layers and one or more insulating layers, for example. Semiconductor wafer composition and fabrication techniques are well known in the art and thus are omitted for the sake of brevity. However, typically, such wafers 200 have not included temperature sensors.

Figure 3:
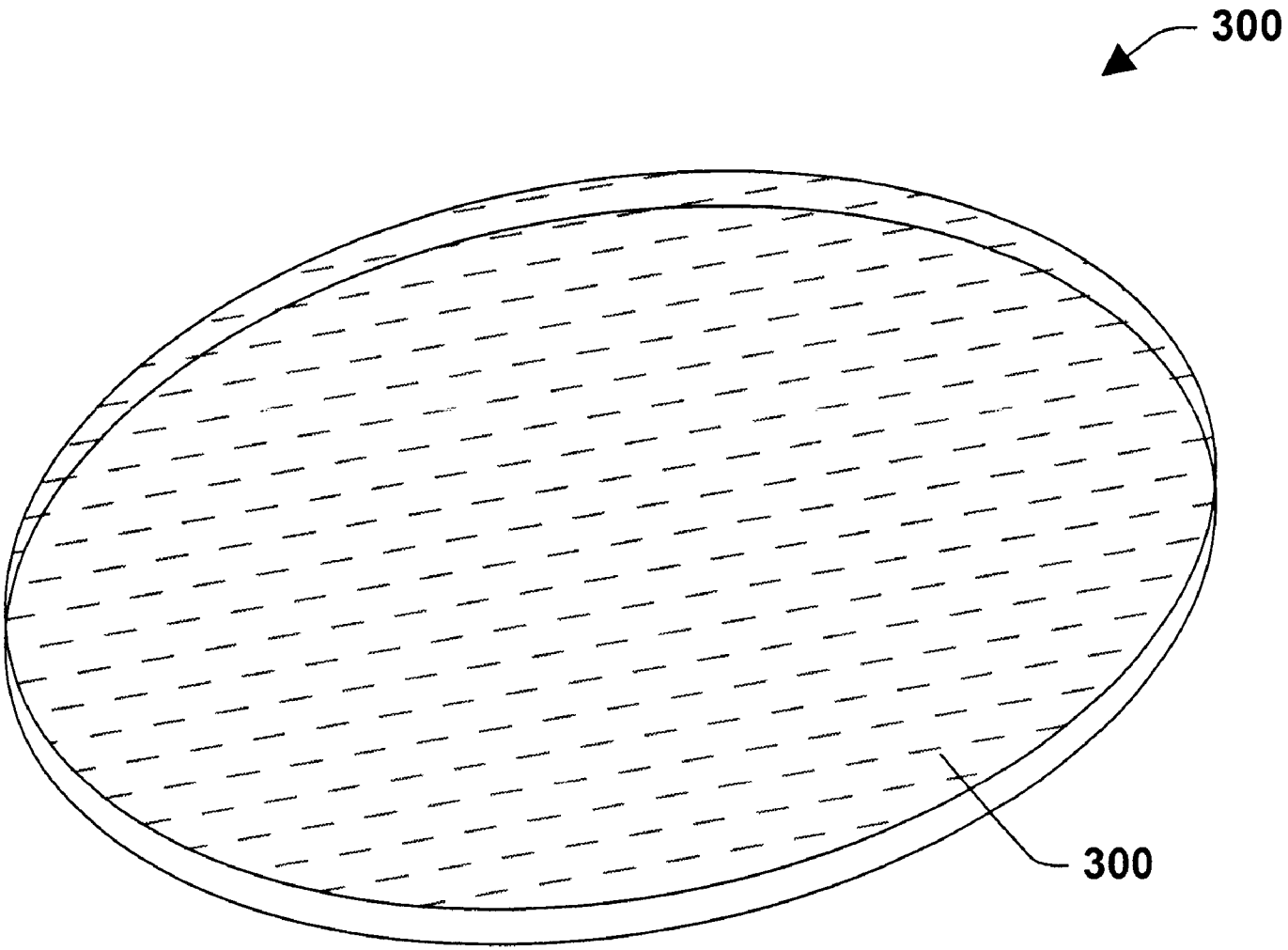
FIG. 3 illustrates a wafer with associated temperature sensors, in accordance with an aspect of the present invention.

Thus, FIG. 3 illustrates a wafer 300 that includes a plurality of temperature sensors 310. While FIG. 3 illustrates a plurality of temperature sensors 310, it is to be appreciated that a single temperature sensor or two or more temperature sensors may be employed with the present invention. Such temperature sensors 310 may be arranged on the wafer 300 in various schemes. For example, in FIG. 3, the sensors are arranged in a broken linear pattern. Other arrangements may include, but are not limited to, broken and unbroken linear, circular, ellipsoidal, sinusoidal, hyperbolic, parabolic and wave arrangements. Furthermore, the sensors 310 may be arranged according to a matrix, a pattern and/or randomly, for example. Various arrangements may be employed to facilitate optimizing various temperature recording schemes. By way of illustration, in a first CMP process, substantial uniformity of temperature throughout the wafer 300 may be required during CMP, thus, a more dense temperature sensor pattern may be employed. By way of further illustration, in a second CMP process, understanding radial temperature gradients may be important, thus a circular temperature sensor pattern may be employed. It is to be appreciated that various patterns may be employed to facilitate characterizing various CMP properties.

Figure 4:
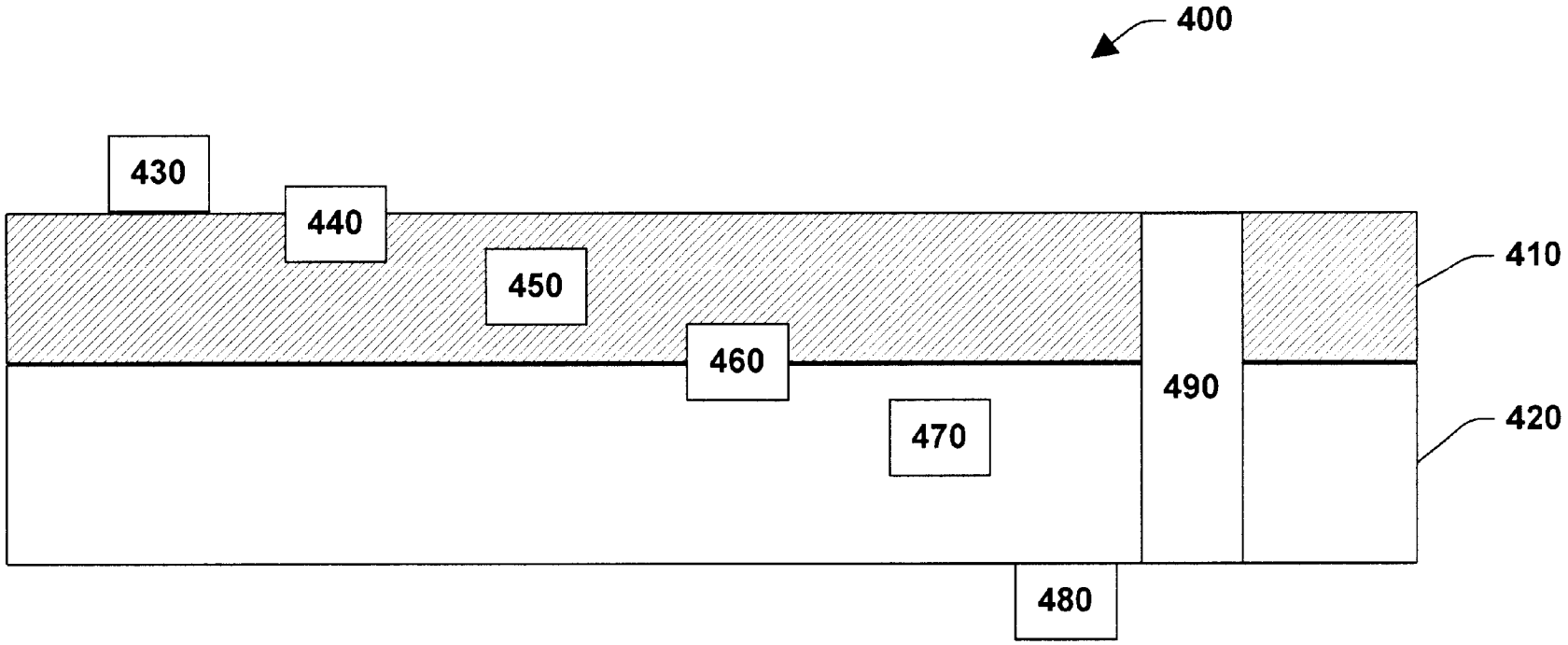
FIG. 4 illustrates a wafer with a metal layer and a substrate associated with various configurations of temperature sensors, in accordance with an aspect of the present invention.

In CMP, a chemical reaction (e.g., oxidation) may occur on or near the surface of a layer (e.g., a metal layer). Other chemical reactions (e.g., hydrolysis of Si—O—Si bonds) may also be involved in CMP. Thus, the temperature of the surface of the wafer may be different than the temperature below the surface of the wafer. Furthermore, such chemical reactions may affect temperature sensors, and thus the temperature sensors may be located in a region of the wafer substantially isolated from the chemical reaction. Thus, FIG. 4 is a cross section illustration of a wafer 400 formed from a metal layer 410 and a substrate layer 420 in which various temperature sensor locations-are presented.

A first temperature sensor 430 is illustrated as being positioned on the metal layer 410 while a second temperature sensor 440 is illustrated as being positioned above and in the metal layer 410 and a third temperature sensor 450 is illustrated as being positioned wholly in the metal layer 410. Other illustrated temperature sensor locations include in both the metal layer 410 and the substrate layer 420 (sensor 460), wholly in the substrate layer 420 (sensor 470), on the substrate layer 420 (sensor 480) and spanning substantially the metal layer 410 and the substrate layer 420 (sensor 490). While FIG. 4 illustrates seven temperature sensor locations, it is to be appreciated that a wafer 400 may be fabricated with a greater and/or lesser number of temperature sensor locations and that other temperature sensor locations can be employed in accordance with the present invention. It is to be further appreciated that although a metal layer is illustrated, that sensors may be employed in other layers including, but not limited to, polysilicon layers and dielectric layers. It is to be appreciated that various temperature sensor locations may be employed to facilitate characterizing different CMP parameters and thus such sensor locations may be distributed throughout the various sensor pattern arrangements described above in connection with FIG. 3.

Figure 5:
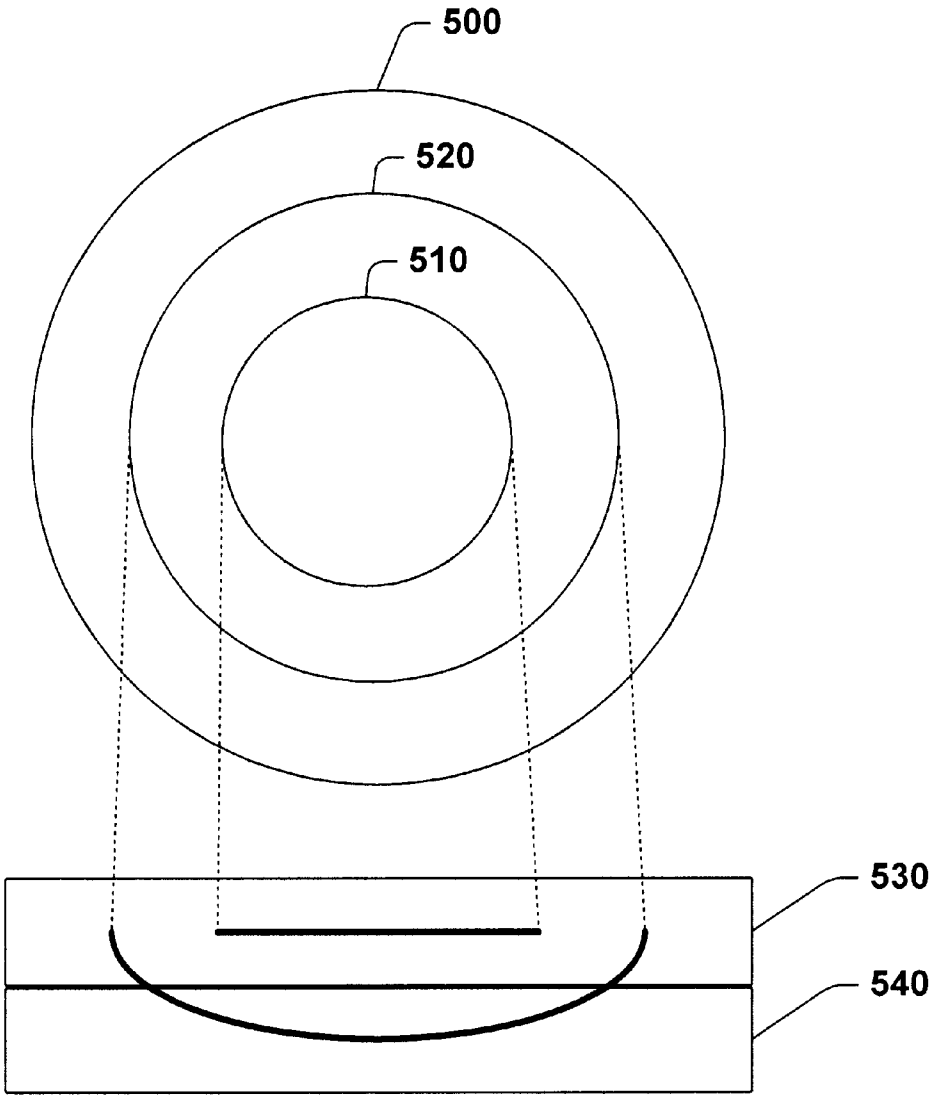
FIG. 5 illustrates a wafer with associated temperature sensors, in accordance with an aspect of the present invention.

Thus, FIG. 5 presents a top view and a cross section view of a wafer 500. The wafer 500 has two ring temperature sensors. The first ring 510 is placed at a substantially uniform depth within a metal layer 530 of the wafer 500. The second ring 520 is distributed at different levels throughout the metal layer 530 and a substrate layer 540. While FIG. 5 illustrates continuous rings, FIG. 6 illustrates broken rings.

Figure 6:
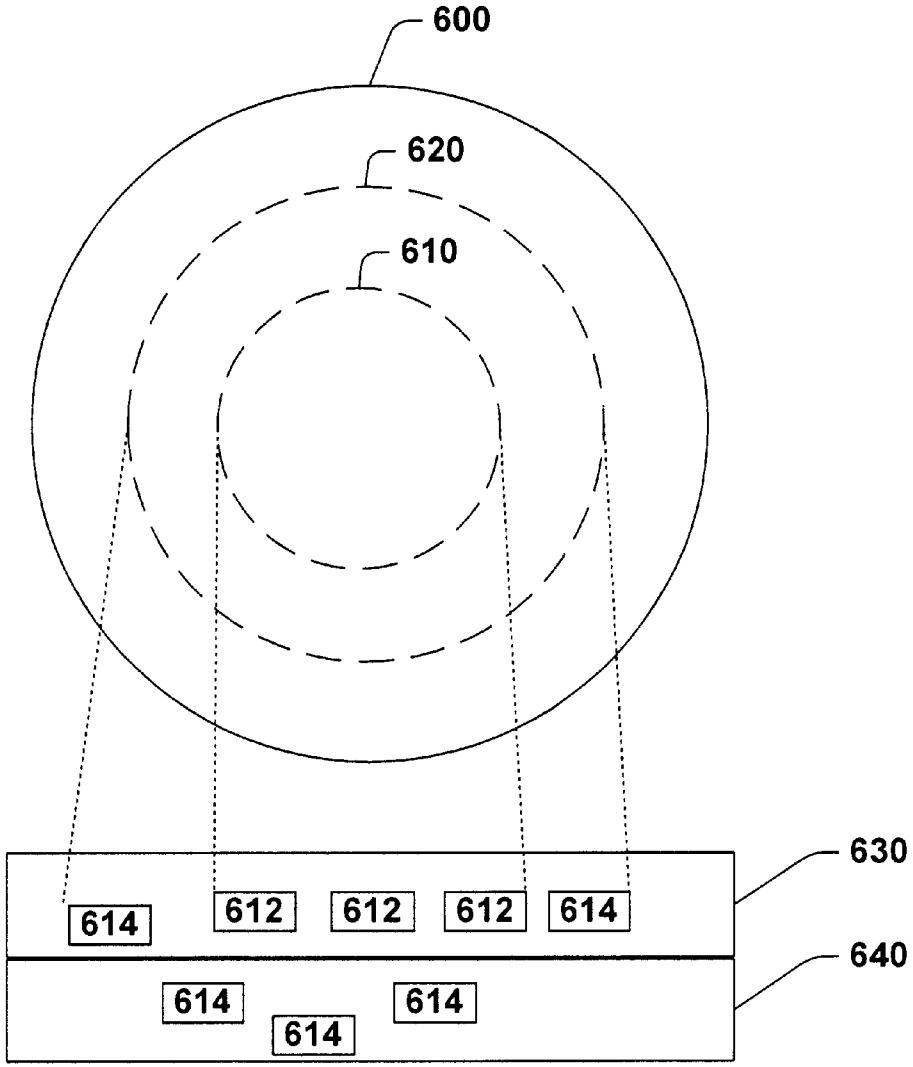
FIG. 6 illustrates a wafer with associated temperature sensors, in accordance with an aspect of the present invention.

FIG. 6 presents a top view and a cross section view of a wafer 600. The wafer 600 has two broken rings of temperature sensors. The first ring 610 is formed of sensors 612 placed at a substantially uniform depth within a metal layer 630 of the wafer 600. The second ring 620 is formed of sensors 614 distributed at different levels throughout the metal layer 630 and the substrate layer 640. While FIGS. 5 and 6 illustrate two possible arrangements and depth distributions, it is to be appreciated that other arrangements and depth distributions can be employed in accordance with the present invention. Furthermore, while FIGS. 5 and 6 illustrate temperature sensors in a wafer, it is to be appreciated that other temperature sensor related equipment (e.g., signal processing circuitry, power source, electrical temperature transducer, etc.) may be incorporated onto and/or into a wafer in accordance with the present invention to facilitate reading temperature data from temperature sensors associated with a wafer. Furthermore, while neither FIG. 5 nor FIG. 6 illustrate IC features fabricated into and/or onto a wafer, it is to be appreciated that such features may co-exist with the temperature sensors and/or temperature sensing equipment. Further still, while FIGS. 5 and 6 illustrate a metal layer, it is to be appreciated that the present invention may employed in the CMP of other layer types.

Figure 7:
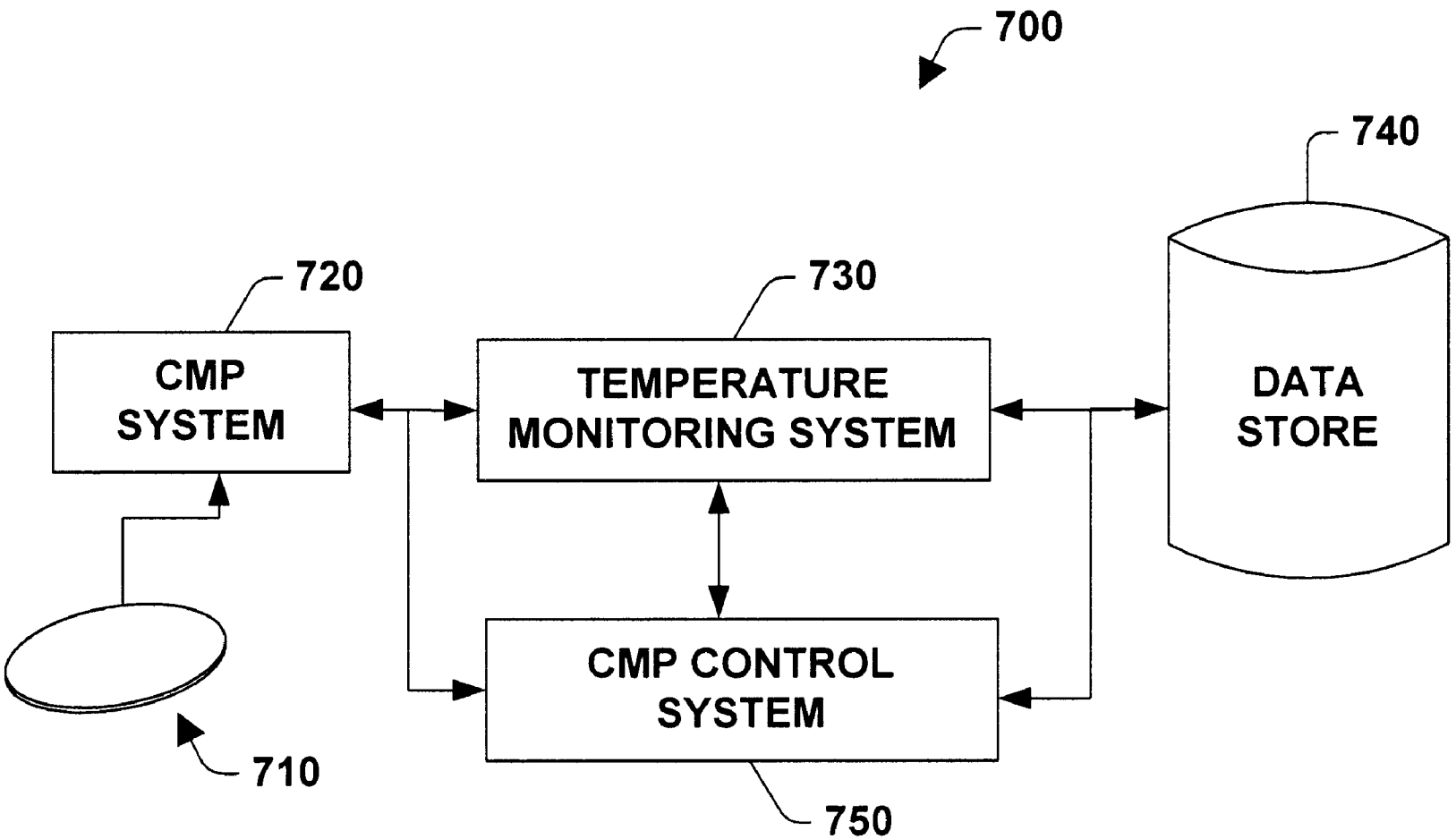
FIG. 7 is a block diagram of a CMP characterizing and controlling system, in accordance with an aspect of the present invention.

Turning now to FIG. 7, a block diagram of a CMP characterizing and controlling system 700 is illustrated. Like the CMP characterizing system 100 (FIG. 1), the system 700 includes a wafer 710 that is associated with one or more temperature sensors as described above. But while the system 100 was employed to characterize a CMP process, the system 700 may be employed, for example, to characterize and/or control a CMP process. Thus, during a characterizing only phase, the wafer 710 may be a temperature test wafer (e.g., contains only temperature sensors and/or temperature sensing equipment) but during a characterizing and/or fabrication phase, the wafer 710 may be a production wafer incorporating IC features and/or temperature sensors and/or temperature sensing equipment. Such features may include, but are not limited to, vias, plugs, lines and the like.

The system 700 includes a temperature monitoring system 730 that can be employed to gather temperature information including, but not limited to, the temperature of the wafer 710 before the CMP process, wafer temperatures recorded during the chemical mechanical polishing process and the time associated with such reading, temperatures recorded after revolutions of a polishing pad during the chemical mechanical polishing process and the number of revolutions associated with such reading, and temperatures recorded after one or more percentages of the layers have been removed during the chemical mechanical polishing process and the percentage removed associated with such reading.

As CMP progresses, various temperatures may be monitored. The sequence in which such temperatures are generated can be analyzed to determine the rate at which CMP is progressing and also to predict times when CMP may be substantially completed and/or times when an ex-situ quality control analysis may be appropriate. Furthermore, such a sequence of temperatures may be employed to predict, for example, when subsequent processes are to be scheduled and/or when an abrasive pad should be replaced or conditioned.

For example, at a first point in time T1, a heat signature S1 may have been produced, which indicates that a temperature reading should be taken at a second point in time T2 and a third point in time T3 and that it is likely that the CMP process may terminate at a time T4. Thus, at the second point in time T2 a heat signature S2 may be recorded and at a third point in time T3 a heat signature S3 may be recorded. Furthermore, equipment required for the semiconductor processing of the wafer 710 may be scheduled for T4.

Analyzing the sequence of signatures, and the time required to produce transitions between such signatures can facilitate determining whether CMP is progressing at an acceptable rate, can facilitate predicting optimal times to pause a CMP process to probe the process and can facilitate determining when CMP should be terminated. Feedback information can be generated from such sequence analysis to maintain, increase and/or decrease the rate at which CMP progresses. For example, one or more slurry formulae and/or concentrations can be altered to affect the CMP rate based on the signature sequence analysis. Feed forward information can be generated to facilitate configuring subsequent fabrication processes. For example, feed forward control data employed in apparatus scheduling and/or initialization may be generated and fed forward to one or more processes and/or apparatus. It is to be appreciated that various aspects of the present invention may employ technologies associated with facilitating unconstrained optimization and/or minimization of error costs. Thus, non-linear training systems/methodologies (e.g., back propagation, Bayesian, fuzzy sets, non-linear regression), or other neural networking paradigms including mixture of experts, cerebella model arithmetic computer (CMACS), radial basis functions, directed search networks and function link networks may be employed.

Thus, the system 700 includes a CMP control system 750 that can be employed to analyze temperature information, other information (e.g., pad, pressure, wafer, slurry, motion) and relations between such information to control the CMP system 720. By way of illustration, if a desired temperature has been achieved, then the CMP control system 750 may maintain the CMP parameters. By way of further illustration, if a desired temperature has not been achieved, (e.g., the temperature is too low), then the CMP control system 750 may adjust one or more CMP parameters (e.g., slurry dispense rate, pressure) to facilitate achieving such a desired temperature. More precise temperature control can be employed to facilitate optimizing, for example, the chemical reaction (e.g., oxidation) employed in CMP and thus more precise CMP processes can be achieved, providing advantages over conventional systems.

The system 700 includes a data store 740 that can be employed to store the temperature data, and other information (e.g., pad, slurry, pressure, motion) and relationship data. Such data can be stored in data structures including, but not limited to one or more lists, arrays, tables, databases (relational, hierarchical), stacks, heaps, linked lists and data cubes. Furthermore, the data can be stored in manners to facilitate processing like on line analytical processing (OLAP), data mining and online process control (OPC). The data can reside on one physical device and/or may be distributed between two or more physical devices (e.g., disk drives, tape drives, memory units). Analyses associated with the data stored in the data store 740 can be employed to control one or more CMP parameters (e.g., formula, concentration, time, pressure, rotation speed) and in the present invention can be employed to terminate and/or pause CMP, for example.

In one example of the present invention, the temperature monitoring system 730 includes a relater that can be employed to produce relations between information including, but not limited to, wafer information, temperature information, pad information, slurry information, pressure information and motion information, for example. Such relations may be stored, for example, in the data store 740. Such relations may be stored, for example, in a relational database record, a hierarchical database record, an OLAP record, a data cube dimension record, an object and the like. The relater may be, for example, a computer component. As used in this application, the term "component" is intended to refer to a computer-related entity, either hardware, a combination of hardware and software, software, or software in execution. For example, a component may be, but is not limited to being, a process running on a processor, a processor, an object, an executable, a thread of execution, a program, and a computer. By way of illustration, both an application running on a server and the server can be a component.

In one example of the present invention, the CMP control system 750 may include an initializer that can be employed, for example, to initialize the CMP system 720 and/or a CMP process based on CMP characterization data. The initializer may be, for example, a computer component. Such initialization may be based, at least in part, on characterization data retrieved from the data store 740, the temperature monitoring system 730 and/or the CMP system 720. For example, when the CMP system 720 is presented with a wafer 710 with known characteristics (e.g., layer type, thickness, initial planarity, desired planarity, etc.), the CMP control system 750 may configure parameters including, but not limited to, one or more pressures (e.g., initial, average, maximum, minimum) at which the CMP system 720 should operate, the speed (e.g., initial, average, maximum, minimum) at which the CMP system 720 should operate, slurry parameters (e.g., formula, pH, concentration, particle density, at particle size, etc.) and pad parameters (e.g., use current pad, get different pad, etc.). Thus, the CMP control system 750 can be employed to facilitate establishing initial parameters for the CMP system 720, which facilitates producing a desired CMP process (e.g., desired removal rate, desired defect level, desired planarity, desired uniformity) that can be monitored via the wafer 710 based sensors.

In another example of the present invention, the CMP control system further includes a controller that can be employed, in-situ, to update one or more CMP parameters (e.g., pressure, speed, slurry properties) to facilitate producing a higher quality CMP. Such in-situ control may be based, for example, on temperatures read from the wafer 710 during CMP, where the temperatures are correlated with the characterization data stored, for example, in the data store 740. The controller may be, for example, a computer component.

Figure 8:
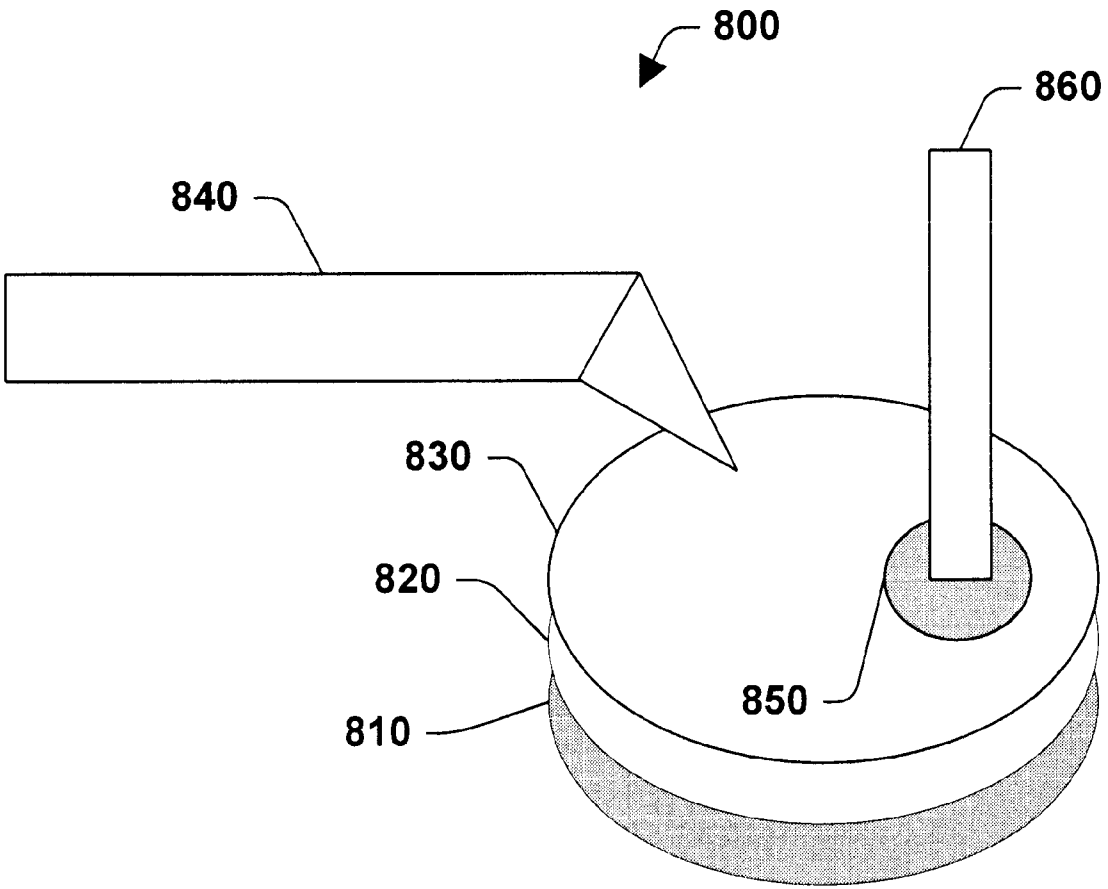
FIG. 8 illustrates one example CMP system.

FIG. 8 illustrates one example CMP system 800. Such systems are well known in the art and thus are only briefly discussed herein. The system 800 includes a rotating platen 810 upon which a polishing pad 820 has been placed. A slurry dispenser 840 is employed to dispense a layer of slurry 830 onto the polishing pad 820. A wafer 850, upon which a chemical reaction (e.g., oxidation, hydrolysis) is and/or has occurred is maneuvered by a wafer carrier 860 to be brought in contact with the slurry 830 and/or the abrasive pad 820 to facilitate removing the reaction products. While a slurry system is illustrated, it is to be appreciated that the present invention can be employed in accordance with non-slurry systems. It is to be further appreciated that while a rotary system is illustrated, that the present invention can be employed with other systems (e g., linear, orbital, etc.). Also, while a single wafer 850 and a single wafer carrier 860 are illustrated, it is to be appreciated that multiple wafer and/or wafer carrier systems can be employed in accordance with the present invention.

Figure 9:
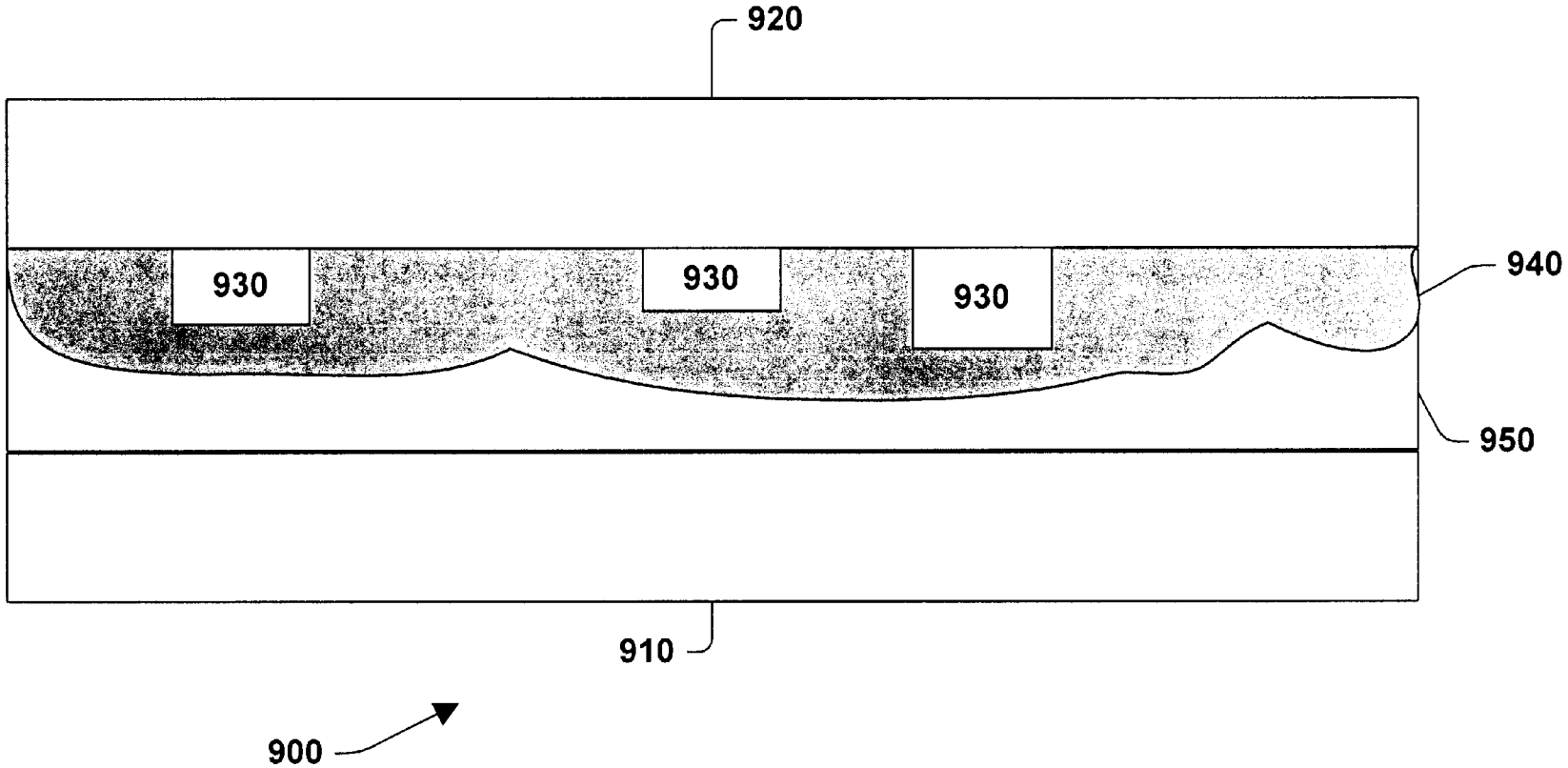
FIG. 9 illustrates an example CMP process.

FIG. 9 illustrates an example CMP process. Again, such CMP processes are well known in the art and thus are discussed only briefly herein for brevity. A wafer 920, whereupon one or more features 930 have been fabricated, and upon which a metal film 940 has been deposited, is presented to a CMP system 900 that includes a pad 910 upon which a slurry 950 has been dispensed. While a metal film 940 is described in association with FIG. 9, it is to be appreciated that CMP of other layers (e.g., polysilicon, dielectric) may be characterized by the present invention. The abrasive particles in the slurry 950 and/or pad 910 are employed to remove reaction products from the metal film 940, which facilitates planarizing the metal film 940 and/or the features 930.

Figure 10:
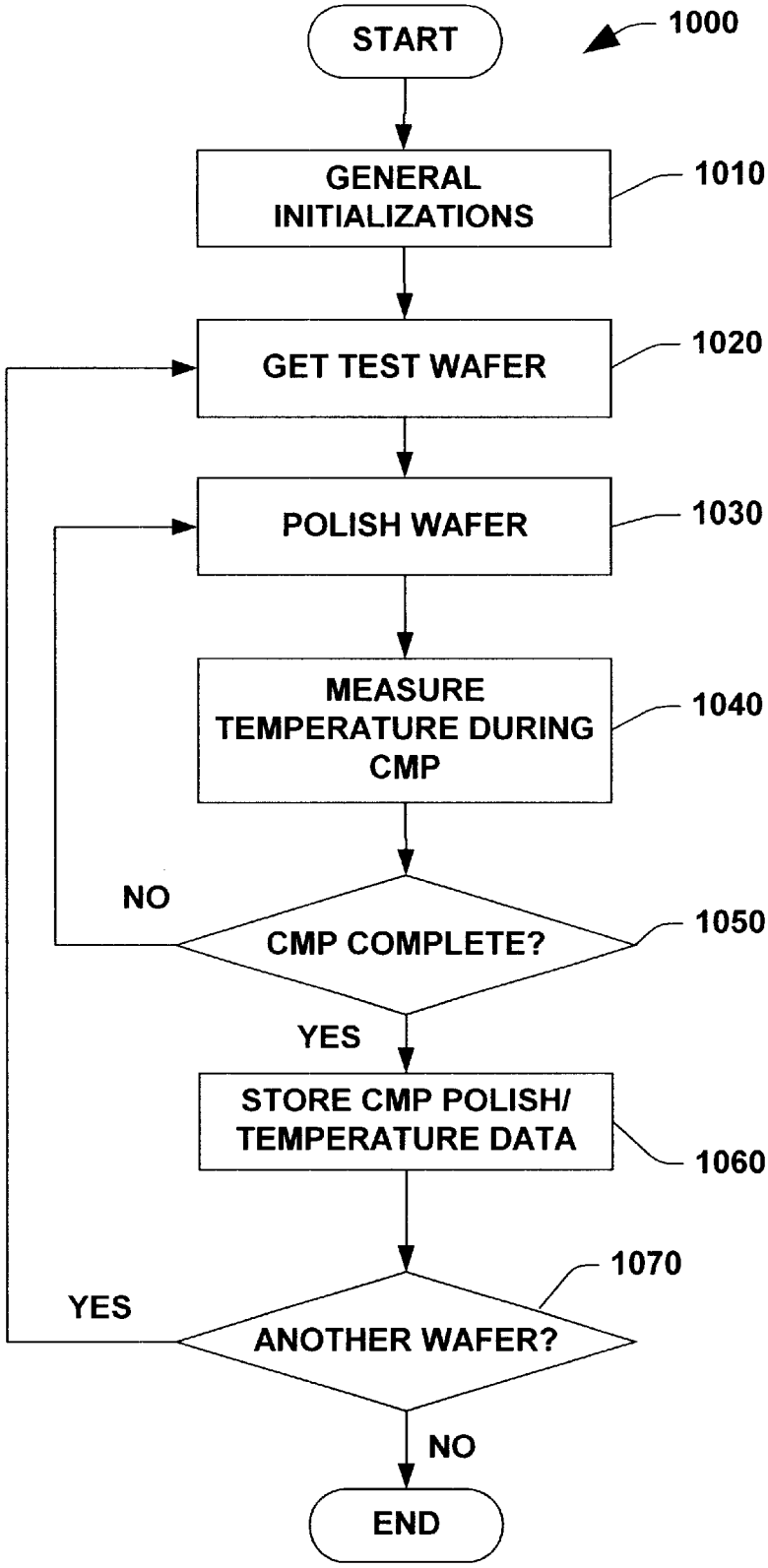
FIG. 10 is a flow diagram illustrating an example methodology for characterizing a CMP process, in accordance with an aspect of the present invention.
Figure 11:
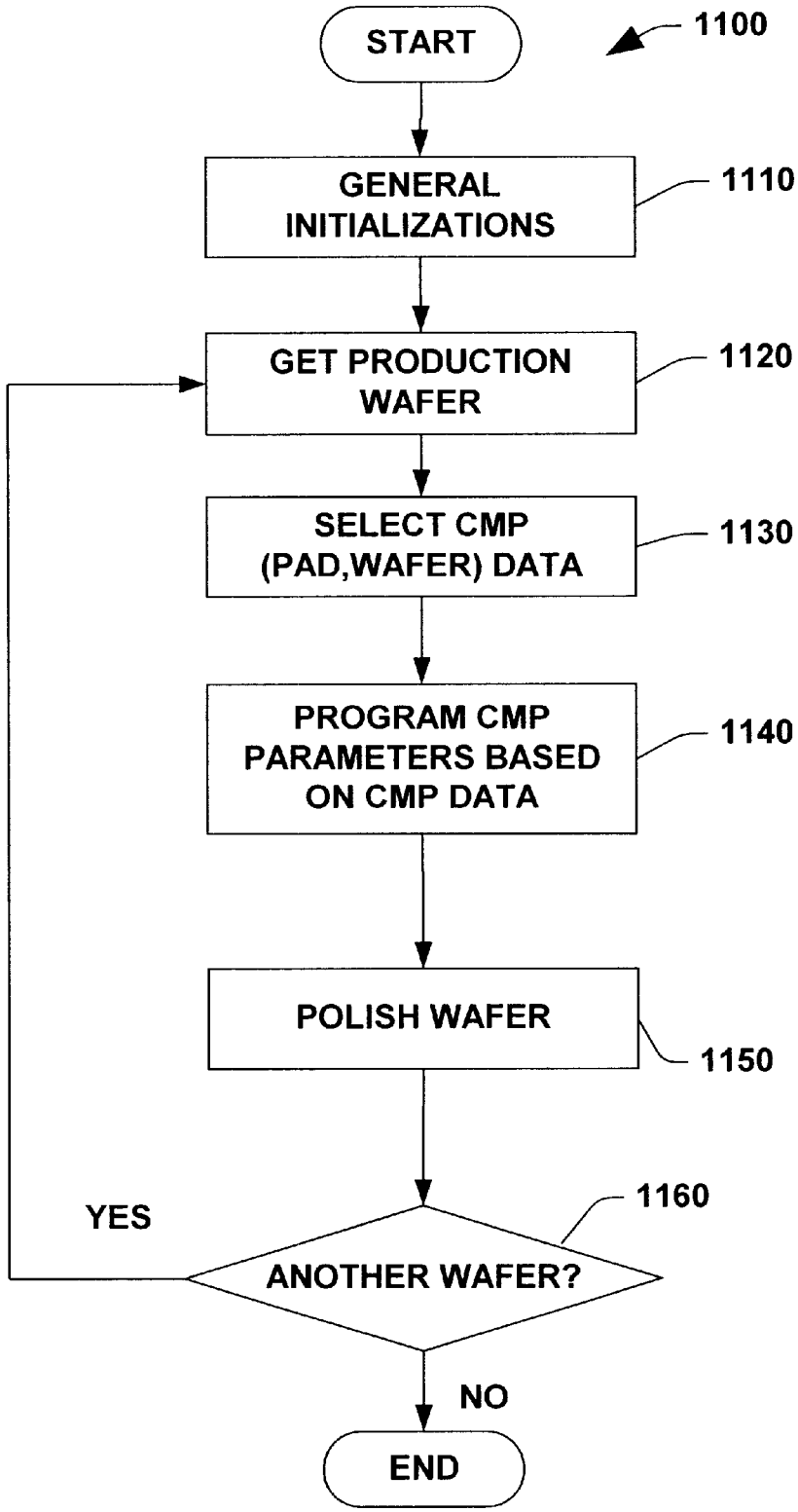
FIG. 11, is a flow diagram illustrating an example methodology for programming a CMP process based, at least in part, on CMP characterization data, in accordance with an aspect of the present invention.
Figure 13:
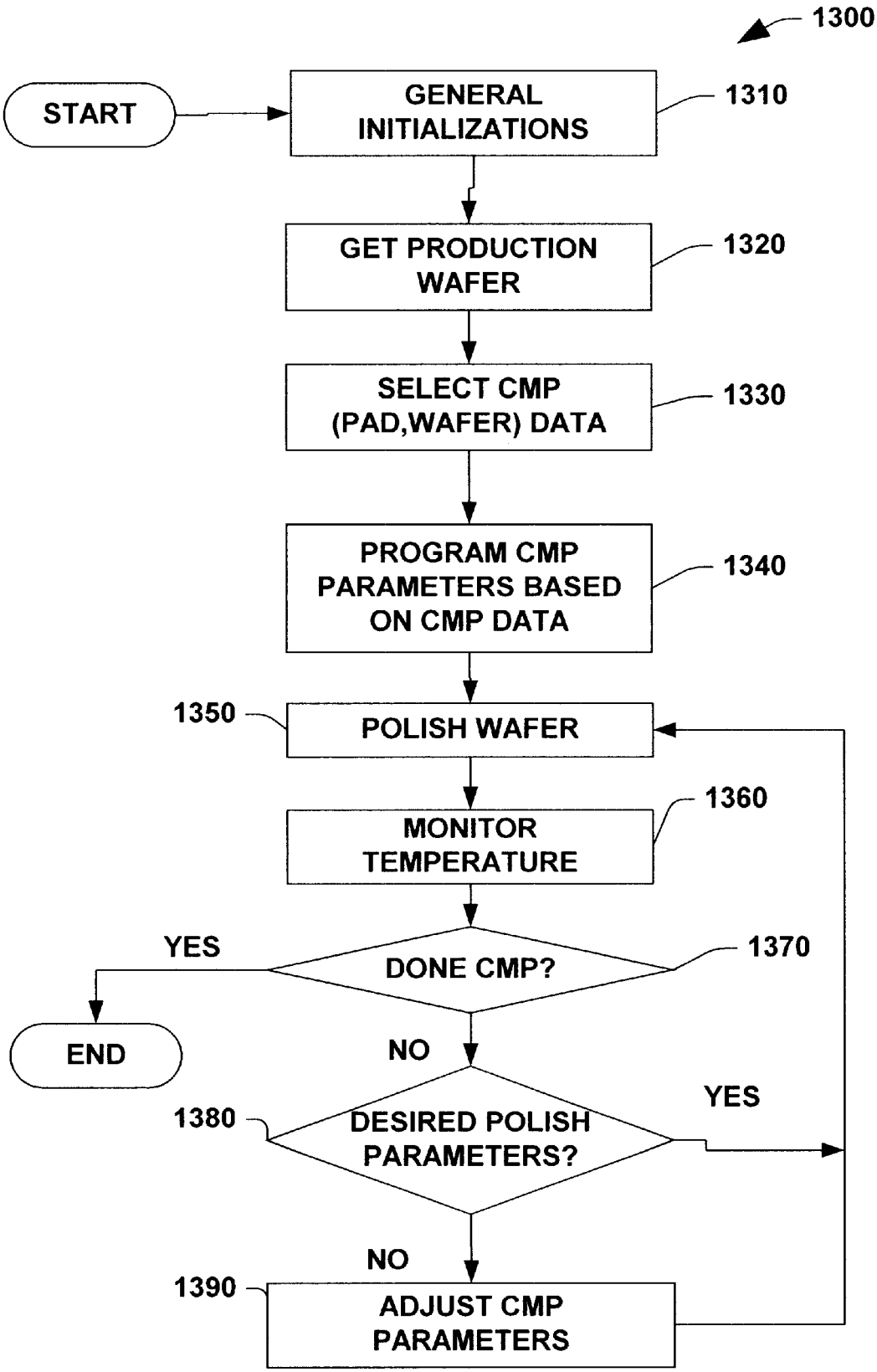
FIG. 13 is a flow diagram illustrating an example methodology for monitoring and/or controlling a CMP process based, at least in part, on CMP characterization data, in accordance with an aspect of the present invention.

In view of the exemplary systems shown and described above, methodologies that may be implemented in accordance with the present invention will be better appreciated with reference to the flow charts of FIGS. 10, 11 and 13. While, for purposes of simplicity of explanation, the methodologies are shown and described as a series of blocks, it is to be understood and appreciated that the present invention is not limited by the order of the blocks, as some blocks may, in accordance with the present invention, occur in different orders and/or concurrently with other blocks from that shown and described herein. Moreover, not all illustrated blocks may be required to implement a methodology in accordance with the present invention.

FIG. 10 is a flow diagram illustrating one particular methodology 1000 for carrying out a characterization portion of the present invention. At 1010, general initializations occur. The initializations may include, but are not limited to, establishing data communications, establishing initial values, identifying communicating apparatus and/or processes and positioning CMP means and products, for example. At 1020, a test wafer is acquired. As described above, one or more temperature sensors arranged in various patterns at various depths in diverse layers may be associated with the test wafer. CMP processes performed on test wafers of varying thickness, with different metal layers (e.g., Cu, Ti, Ta, W. Al etc.), with different non-metal layers (e.g., polysilicon, dielectric) with or without IC features may be characterized by the method 1000. While one characterization process may focus on a small set of wafers (e.g., all Cu, same pattern, same depths), a different characterization process may employ a larger set of wafers (e.g., Cu and Ti, different patterns, different depths) to facilitate characterizing different CMP processes. At 1030, polishing the wafer begins. Information including, but not limited to wafer data, pad data, pressure data, motion data and/or slurry data, for example, may be recorded to facilitate creating relations that can be employed in characterizing the CMP process. At 1040, a temperature is read from the test wafer. While one temperature is described, it is to be appreciated that one or more temperatures from one or more sensors may be read at 1040. Furthermore, it is to be appreciated that block 1040 may be performed substantially in parallel with block 1030. The so temperature readings may be gathered, for example, continuously and/or at discrete time intervals. The measuring at 1040 may measure, for example, absolute temperatures, temperature differentials, temperature gradients, and the like. The temperature information may include, but is not limited to, the temperature of a wafer before the CMP process, wafer temperatures recorded during the chemical mechanical polishing process and the time associated with such reading, temperatures recorded after revolutions of a polishing pad during the chemical mechanical polishing process and the number of revolutions associated with such reading, and temperatures recorded after percentages of the layers have been removed during the chemical mechanical polishing process and the percentage removed associated with such reading.

At 1050, a determination is made concerning whether the CMP is complete. If the determination at 1050 is NO, then processing returns to 1030. While block 1050 is shown as a discrete block, separate from 1030 and 1040, it is to be appreciated that such blocks may be performed substantially in parallel. If the determination at 1050 is YES, then at 1060, information is stored. Such information can include, but is not limited to, temperature information, slurry information, pad information, pressure information, motion information and polish data (e.g., polish time, material removed, number of revolutions, etc.). At 1060, in addition to and/or alternatively, relations between the information described above may be stored. Such relations may be employed, for example, in subsequent characterization analyses that employ techniques including, but not limited to, data mining, database analysis, regression analysis, neural network processing, machine learning analyses and other analytical techniques. Thus, the CMP process can be characterized. Such characterization may include, but is not limited to, producing information concerning wafer temperature as related to polishing rate, polishing uniformity, polishing time, polishing effects on pads, slurry usage and the introduction of defects to the wafer. Such characterization data can be employed, for example, to facilitate initializing production CMP runs to optimize such production runs by controlling wafer temperature and/or it may also be employed in controlling a CMP process.

At 1070 a determination is made concerning whether there is another wafer to polish during the CMP characterization process. If the determination at 1070 is NO, then processing can conclude, otherwise processing may return to 1020.

FIG. 11 is a flow diagram illustrating one particular methodology 1100 for carrying out a production run portion of the present invention that benefits from a characterization portion of the present invention like that described in association with FIG. 10. At 1110, general initializations occur. The initializations may include, but are not limited to, establishing data communications, establishing initial values, identifying communicating apparatus and/or processes and positioning chemical mechanical polishing means and products, for example.

At 1110, a production wafer is acquired. Such a production wafer may include IC features (e.g., vias, lines, holes, etc.) and may include one or more metal layers and/or substrate layers. Based, at least in part, on information concerning the production wafer (e.g., type of metal layer, thickness of layer, current planarity, desired planarity, ratio of up area to down area, etc.), and other information (e.g., pad information, slurry information, pressure information, motion information), at 1130, initial CMP parameters may be retrieved. By way of illustration, during a characterization process, a relationship between wafer temperature and metal layer thickness, desired removal amount, desired removal rate and slurry formula, concentration and dispense rate may have been produced. Thus, rather than employ generic CMP parameters that may not produce desired wafer temperatures, a CMP apparatus and/or process may benefit from the relationship identified during the previous characterization process. Thus, at 1140, the CMP apparatus and/or process may be programmed based on such relationship and/or other retrieved data to facilitate achieving and/or maintaining desired wafer temperatures. By way of illustration, a production wafer whereupon there has been deposited a copper metal layer may be presented for CMP. It may be desired to remove approximately 0.75 $\mu$m of the copper at a rate of approximately 150 nm/min with a desired resulting planarity of 99.95% with less than 0.02% variation within a wafer. Such parameters and rates may be related with one or more wafer temperatures as identified during CMP characterization. Based on such data, and on characterization data produced during a characterization phase, a slurry formula, concentration and dispense rate may be chosen that will increase the likelihood that a desired temperature will be achieved and thus that such polishing will be achieved, given the current state of the pad, for example.

At 1150, the wafer is polished and at 1160 a determination is made concerning whether there is another wafer to polish. If the determination at 1160 is NO, then processing may conclude, otherwise processing may return to 1120.

Figure 12:
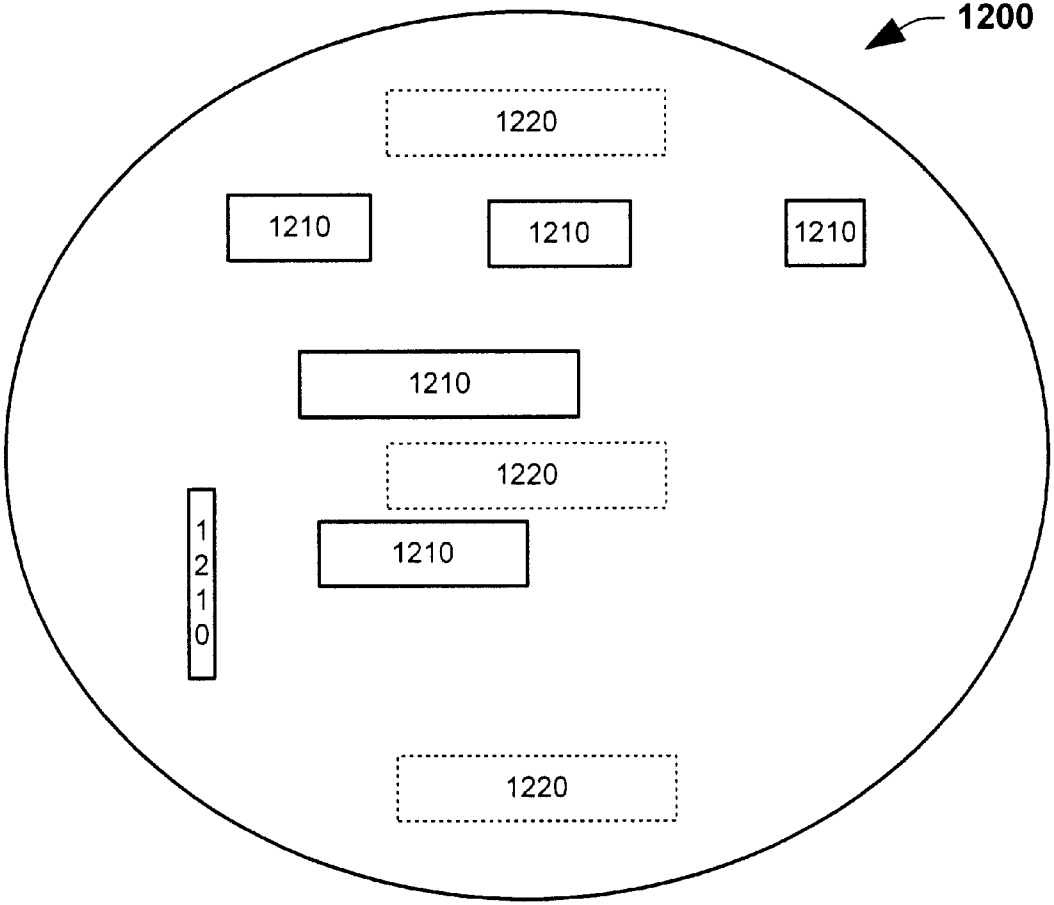
FIG. 12 illustrates a wafer with features and temperature sensors, in accordance with an aspect of the present invention.

While FIGS. 10 and 11 describe a bifurcated system, where characterization occurs and then production wafers are fabricated, FIG. 12 concerns a wafer 1200 with IC features 1210 and temperature sensors 1220 that can be employed, for example, by a method like that described in association with FIG. 13 to control a CMP process and/or to characterize a CMP process during production. Thus, FIG. 12 illustrates a wafer 1200 whereupon IC features 1210 have been fabricated. While six IC features 1210 are illustrated, it is to be appreciated that a greater and/or lesser number of such features may be present. Similarly, while three temperature sensors 1220 are illustrated in a broken linear pattern, it is to be appreciated that a greater and/or lesser number of temperature sensors 1220 arranged in various patterns at various depths may be employed.

FIG. 13 is a flow diagram illustrating one particular methodology 1300 for carrying out in-situ monitoring, controlling and/or characterization of a CMP process. At 1310, general initializations occur. The initializations may include, but are not limited to, establishing data communications, establishing initial values, identifying communicating apparatus and/or processes and positioning chemical mechanical polishing means and products, for example.

At 1320, a production wafer is presented to the method 1300. Such a production wafer may include IC features (e.g., vias, lines, holes, etc.) and may include one or more metal layers, polysilicon layers, dielectric layers and/or substrate layers and may also include one or more temperature sensors and associated temperature sensing equipment (e.g., circuitry, power supply, transducer). Based, at least in part, on information concerning the production wafer (e.g., type of layer, thickness of layer, current planarity, desired planarity, ratio of up area to down area, etc.), and other information (e.g., sensor information, pad information, slurry information, pressure information, motion information), at 1330, initial CMP parameters may be retrieved. Such parameters may be established to facilitate achieving and/or maintaining wafer temperature during CMP, which can facilitate achieving more precise chemical reactions in the CMP process. At 1340, the CMP apparatus and/or process may be programmed based on such relationship and/or other retrieved data. By way of illustration, a production wafer whereupon there has been deposited a titanium metal layer may be presented for CMP. It may be desired to remove approximately 0.50 $\mu$m of the titanium at a rate of approximately 200 nm/min with a desired resulting planarity of 97.5% with less than 0.05% variation within a wafer. Based on such data, and on characterization data produced during a characterization phase, a slurry formula, concentration and dispense rate may be chosen that will increase the likelihood that a desired wafer temperature will be achieved and/or maintained and thus that such desired polishing will be achieved. Such selections may be predicated on the resulting wafer temperature and reaction rate.

At 1350, the wafer is polished and at 1360 temperature information is recorded from the wafer based temperature sensors. While blocks 1350 and 1360 are illustrated as discrete blocks, it is to be appreciated that blocks 1350 and 1360 may be performed substantially in parallel so that temperature monitoring can occur while the CMP is in progress. At 1370, a determination is made concerning whether the CMP is complete.

If the determination at 1370 is YES, then processing can conclude, otherwise, processing may proceed to 1380. At 1380, a determination is made concerning whether desired polish parameters (e.g., time, rate, planarity, etc.) are being achieved by the CMP process. Such a determination may be based, for example, on the temperature of the wafer. If the determination at 1380 is YES, then processing may return to 1350. But if the determination at 1380 is NO, then at 1390, one or more CMP parameters may be adjusted. By way of illustration and not limitation, CMP parameters including, but not limited to pressure, motion, speed, slurry dispense rate, and the like, may be adapted. By way of further illustration, if the desired rate of removal of the 0.50 $\mu$m of the titanium of 200 nm/min is not being met, for example, if only 100 nm/min is being achieved, possibly because the wafer temperature is too low and the oxidation is not occurring at a sufficient rate, then the slurry dispense rate, the speed and/or the pressure may be adapted in an attempt to increase the removal rate by increasing the wafer temperature and thus the oxidation rate. Furthermore, if the removal rate is not being met, then pad reconditioning and/or replacement may be scheduled. Such adaptations are facilitated by the relationships between temperature and CMP factors as determined during a characterization process. In one example of the present invention, to facilitate providing an up-to-date CMP characterization, the temperature data monitored at 1360 may be employed to update the characterization data.

The invention may be described in the general context of computer-executable instructions, such as program modules, executed by one or more components. Generally, program modules include routines, programs, objects, data structures, etc. that perform particular tasks or implement particular abstract data types. Typically the functionality of the program modules may be combined or distributed as desired in various embodiments. Furthermore, computer executable instructions operable to perform the methods described herein may be stored on computer readable media.

Figure 14:
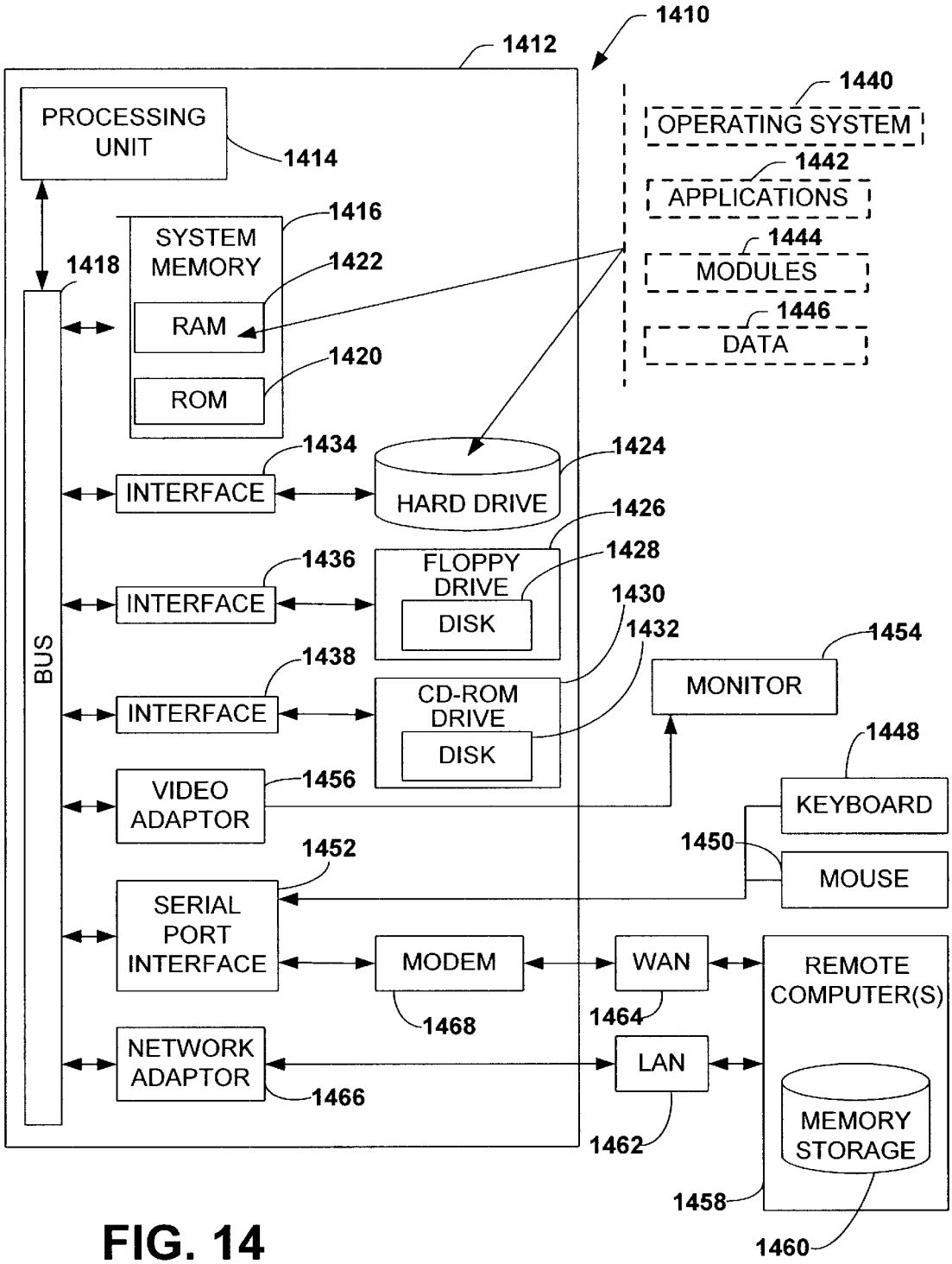
FIG. 14 is a schematic block diagram of an exemplary operating environment for a system configured in accordance with the present invention.

In order to provide additional context for various aspects of the present invention, FIG. 14 and the following discussion are intended to provide a brief, general description of one possible suitable computing environment 1410 in which the various aspects of the present invention may be implemented. It is to be appreciated that the computing environment 1410 is but one possible computing environment and is not intended to limit the computing environments with which the present invention can be employed. While the invention has been described above in the general context of computer-executable instructions that may run on one or more computers, it is to be recognized that the invention also may be implemented in combination with other program modules and/or as a combination of hardware and software. Generally, program modules include routines, programs, components, data structures, etc. that perform particular tasks or implement particular abstract data types. Moreover, one will appreciate that the inventive methods may be practiced with other computer system configurations, including single-processor or multiprocessor computer systems, minicomputers, mainframe computers, as well as personal computers, hand-held computing devices, microprocessor-based or programmable consumer electronics, and the like, each of which may be operatively coupled to one or more associated devices (e.g., CMP apparatus). The illustrated aspects of the invention may also be practiced in distributed computing environments where certain tasks are performed by remote processing devices that are linked through a communications network. In a distributed computing environment, program modules may be located in both local and remote memory storage devices.

FIG. 14 illustrates one possible hardware configuration to support the systems and methods described herein. It is to be appreciated that although a standalone architecture is illustrated, that any suitable computing environment can be employed in accordance with the present invention. For example, computing architectures including, but not limited to, stand alone, multiprocessor, distributed, client/server, minicomputer, mainframe, supercomputer, digital and analog can be employed in accordance with the present invention.

With reference to FIG. 14, an exemplary environment 1410 for implementing various aspects of the invention includes a computer 1412, including a processing unit 1414, a system memory 1416, and a system bus 1418 that couples various system components including the system memory to the processing unit 1414. The processing unit 1414 may be any of various available processors. Dual microprocessors and other multi-processor architectures also can be used as the processing unit 1414.

The system bus 1418 may be any of several types of bus structure including a memory bus or memory controller, a peripheral bus, and a local bus using any of a variety of available bus architectures. The computer memory 1416 includes read only memory (ROM) 1420 and random access memory (RAM) 1422. A basic input/output system (BIOS), containing the basic routines that help to transfer information between elements within the computer 1412, such as during start-up, is stored in ROM 1420.

The computer 1412 may further include a hard disk drive 1424, a magnetic disk drive 1426, e.g., to read from or write to a removable disk 1428, and an optical disk drive 1430, e.g., for reading a CD-ROM disk 1432 or to read from or write to other optical media. The hard disk drive 1424, magnetic disk drive 1426, and optical disk drive 1430 are connected to the system bus 1418 by a hard disk drive interface 1434, a magnetic disk drive interface 1436, and an optical drive interface 1438, respectively. The computer 1412 typically includes at least some form of computer readable media. Computer readable media can be any available media that can be accessed by the computer 1412. By way of example, and not limitation, computer readable media may include computer storage media and communication media. Computer storage media includes volatile and nonvolatile, removable and non-removable media implemented in any method or technology for storage of information such as computer readable instructions, data structures, program modules or other data. Computer storage media includes, but is not limited to, random access memory (RAM), read only memory (ROM), electrically erasable programmable read only memory (EEPROM), flash memory or other memory technology, compact disc (CD)-ROM, digital versatile disks (DVD) or other magnetic storage devices, or any other medium which can be used to store the desired information and which can be accessed by the computer 1412. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, radio frequency (RF), infrared and other wireless media. Combinations of any of the above should also be included within the scope of computer readable media.

A number of program modules may be stored in the drives and RAM 1422, including an operating system 1440, one or more application programs 1442, other program modules 1444, and program non-interrupt data 1446. The operating system 1440 in the computer 1412 can be any of a number of available operating systems.

A user may enter commands and information into the computer 1412 through a keyboard 1448 and a pointing device, such as a mouse 1450. Other input devices (not shown) may include a microphone, an infrared (IR) remote control, a joystick, a game pad, a satellite dish, a scanner, or the like. These and other input devices are often connected to the processing unit 1414 through a serial port interface 1452 that is coupled to the system bus 1418, but may be connected by other interfaces, such as a parallel port, a game port, a universal serial bus (USB), an IR interface, etc. A monitor 1454, or other type of display device, is also connected to the system bus 1418 via an interface, such as a video adapter 1456. In addition to the monitor, a computer typically includes other peripheral output devices (not shown), such as speakers, printers etc.

The computer 1412 may operate in a networked environment using logical and/or physical connections to one or more remote computers, such as a remote computer(s) 1458. The remote computer(s) 1458 may be, for example, a workstation, a server computer, a router, a personal computer, microprocessor based entertainment appliance, a peer device or other common network node, and typically includes many or all of the elements described relative to the computer 1412, although, for purposes of brevity, only a memory storage device 1460 is illustrated. The logical connections depicted include a local area network (LAN) 1462 and a wide area network (WAN) 1464. Such networking environments are commonplace in fabrication facilities, offices, enterprise-wide computer networks, intranets and the Internet.

When used in a LAN networking environment, the computer 1412 is connected to the local network 1462 through a network interface or adapter 1466. When used in a WAN networking environment, the computer 1412 typically includes a modem 1468, or is connected to a communications server on the LAN 1462, or has other means for establishing communications over the WAN 1464, such as the Internet. The modem 1468, which may be internal or external, may be connected to the system bus 1418 via the serial port interface 1452. In a networked environment, program modules depicted relative to the computer 1412, or portions thereof, may be stored in the remote memory storage device 1460. It will be appreciated that the network connections shown are exemplary and other means of establishing a communications link between the computers may be used.

Figure 15:
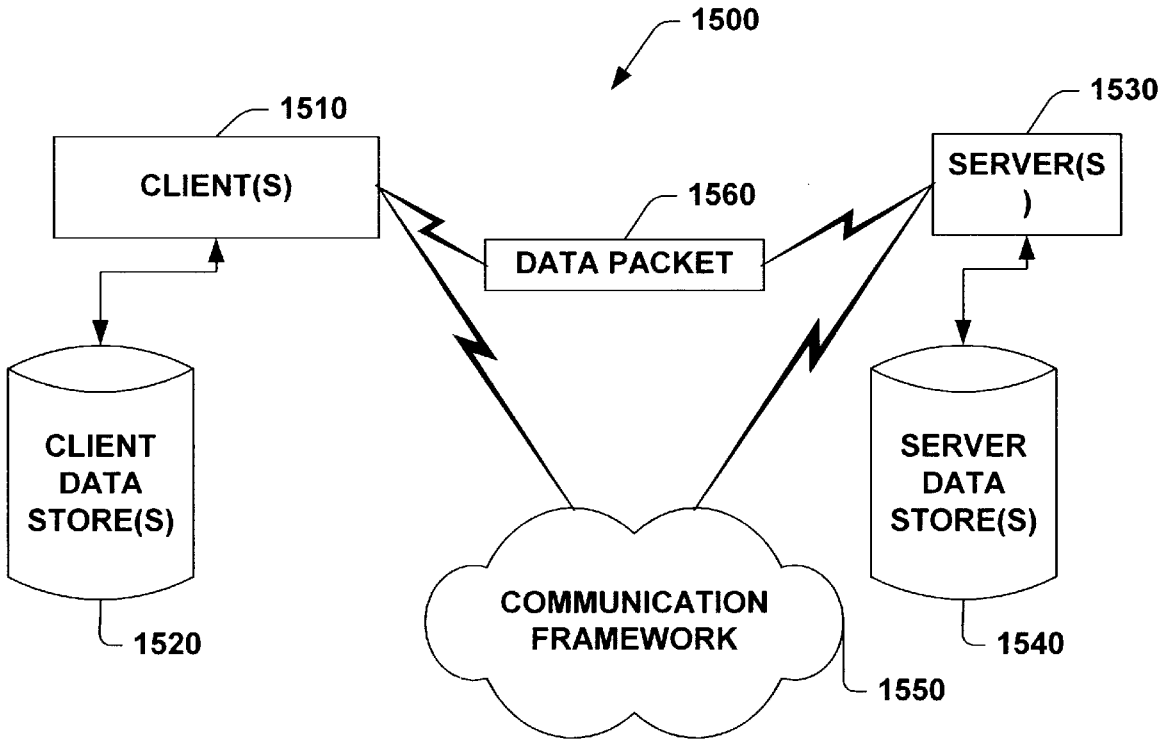
FIG. 15 is a schematic block diagram of an exemplary communication environment for a method performing in accordance with the present invention.

FIG. 15 is a schematic block diagram of a sample computing environment 1500 with which the present invention may interact. The system 1500 includes one or more clients 1510. The clients 1510 may be hardware and/or software (e.g., threads, processes, computing devices). The clients 1510 may house threads that desire to characterize a CMP process by employing the present invention, for example. The system 1500 also includes one or more servers 1530. The servers 1530 may also be hardware and/or software (e.g., threads, processes, computing devices). The servers 1530 may house threads to perform target methods that are to be called asynchronously by employing the present invention, for example.

The system 1500 includes a communication framework 1550 that can be employed to facilitate communications between the clients 1510 and the servers 1530. Such a communication framework 1550 may house remoting features and/or a thread pool, for example. The communication framework 1550 may be employed, for example, to communicate a data packet 1560 between the clients 1510 and the servers 1530. Such a data packet 1560 may include, for example, a first field that stores temperature information gathered from a temperature sensor, where the temperature was acquired by a client 1510. The data packet 1560 may also include, for example, second fields that store one or more control data generated, for example, by a server 1530, that can be employed by the clients 1510 to facilitate controlling a chemical mechanical polishing process.

The clients 1510 are operably connected to one or more client data stores 1515 that can be employed to store information local to the clients 1510 (e.g.,CMP apparatus associations, local temperature data). Similarly, the servers 1530 are operably connected to one or more server data stores 1540 that can be employed to store information local to the servers 1530 (e.g., target methods, CMP analysis programs).

Described above are preferred embodiments of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A system for characterizing a chemical mechanical polishing process, the system comprising:

a wafer comprising one or more layers associated with one or more temperature sensors, wherein at least one of the one or more temperature sensors is embedded in at least one of the layers of the wafer; and a temperature monitoring system operable to read one or more temperatures from the one or more temperature sensors, the temperature monitoring system further operable to analyze the one more temperatures to characterize the chemical mechanical polishing process.

2. The system of claim 1 where the one or more temperature sensors are located at least one of on and in at least one of a metal layer, a polysilicon layer and a dielectric layer.

3. The system of claim 2 where the one or more temperature sensors are arranged at least one of linearly, circularly, in a matrix, randomly and in a pattern.

4. The system of claim 2 where the wafer comprises one or more fabricated features.

5. The system of claim 2 where the one or more temperature sensors are arranged at least one of linearly, circularly, in a matrix, randomly and in a pattern.

6. The system of claim 1, the wafer comprising at least one of a signal processing circuitry, a power source and an electrical temperature transducer.

7. The system of claim 1 where the wafer comprises one or more fabricated features.

8. The system of claim 1 where the temperature monitoring system is operable to read the one or more temperatures at least one of before, during and after the chemical mechanical polishing process.

9. The system of claim 1 comprising a data store adapted to store temperature information.

10. The system of claim 9 where the temperature information comprises at least one of a starting temperature, one or more temperatures recorded at one or more times during the chemical mechanical polishing process, one or more temperatures recorded after one or more passes of a polishing pad during the chemical mechanical polishing process and one or more temperatures recorded after one or more percentages of the one or more layers have been removed during the chemical mechanical polishing process.

11. The system of claim 10 where the data store is further adapted to store at least one of pad information, slurry information, pressure information and motion information.

12. The system of claim 11 where the pad information comprises at least one of the number of wafers polished with a pad and the stiffness of the pad.

13. The system of claim 11 where the slurry information comprises at least one of the solids concentration in the slurry, the formula of the slurry, the pH of the slurry, the dispensing rate of the slurry, the particle size of the slurry and the particle density of the slurry.

14. The system of claim 11 where the pressure information comprises at least one of an initial pressure, an average pressure, a minimum pressure and a maximum pressure.

15. The system of claim 11 where the motion information comprises at least one of a motion type, an initial speed, an average speed, a minimum speed and a maximum speed.

16. The system of claim 11, the temperature monitoring system comprising a relater adapted to produce a relation between at least one of the pad information, the slurry information, the pressure information, the motion information and the temperature information.

17. The system of claim 16 comprising a control system, where the control system comprises an initializer adapted to facilitate initializing at least one of a chemical mechanical polishing process and apparatus based, at least in part, on at least one of the temperature information, the pad information, the slurry information, the pressure information, the motion information and one or more relations between the temperature information, the pad information, the slurry information, the pressure information and the motion information.

18. The system of claim 17, the control system comprising a controller adapted to control at least one of a chemical mechanical polishing process and apparatus based, at least in part, on at least one of the temperature information, the pad information, the slurry information, the pressure information, the motion information, one or more relations between the temperature information, the pad information, the slurry information, the pressure information and the motion information and an incoming monitored temperature data.

19. A method for characterizing a chemical mechanical polishing process, the method comprising:

associating one or more temperature sensors with one or more layers of one or more wafers, wherein at least one of the one or more temperature sensors is embedded in at least one of the layers of the wafer;

chemically mechanically polishing the one or more wafers;

employing a temperature monitoring system to read one or more pieces of temperature information related to the chemical mechanical polishing process from the one or more temperature sensors; and employing the temperature monitoring system to analyze the one or more pieces of temperature information to characterize the chemical mechanical polishing process.

20. The method of claim 19 where the one or more pieces of temperature information are gathered from the one or more temperature sensors at least one of before, during and after chemically mechanically polishing the one or more wafers.

21. The method of claim 20 where the temperature information comprises at least one of a starting temperature, one or more temperatures recorded at one or more times during the chemical mechanical polishing process, one or more temperatures recorded after one or more passes of a polishing pad during the chemical mechanical polishing process and one or more temperatures recorded after one or more percentages of one or more layers have been removed during the chemical mechanical polishing process.

22. The method of claim 19 comprising gathering at least one of pad information, slurry information, pressure information and motion information associated with the chemical mechanical polishing process.

23. The method of claim 22 where the pad information comprises at least one of the number of wafers polished with a pad and the stiffness of the pad.

24. The method of claim 22 where the slurry information comprises at least one of the solids concentration in the slurry, the formula of the slurry, the pH of the slurry, the dispense rate of the slurry, the particle size of the slurry and the particle density of the slurry.

25. The method of claim 22 where the pressure information comprises at least one of an initial pressure, an average pressure, a minimum pressure and a maximum pressure.

26. The system of claim 22 where the motion information comprises at least one of a motion type, an initial speed, an average speed, a minimum speed and a maximum speed.

27. The method of claim 19 comprising producing a relation between at least one of the pad information, the slurry information, the pressure information, the motion information and the temperature information.

28. The method of claim 27 comprising initializing at least one of a chemical mechanical polishing process and apparatus based, at least in part, on at least one of the temperature information, the pad information, the slurry information, the pressure information, the motion information and one or more relations between the temperature information, the pad information, the slurry information, the pressure information and the motion information.

29. The method of claim 28 comprising controlling at least one of a chemical mechanical polishing process and apparatus based, at least in part, on at least one of the temperature information, the pad information, the slurry information, the pressure information, the motion information, an incoming monitored temperature data and one or more relations between the temperature information, the pad information, the slurry information, the pressure information, the motion information and the incoming monitored temperature data.

30. A computer readable medium storing computer executable instructions operable to perform the method of claim 29.

31. The system of claim 1 comprising a plurality of temperature sensors embedded at a plurality of different depths in the wafer.

* * * * *